US009713924B2

(12) United States Patent
Morooka et al.

(10) Patent No.: US 9,713,924 B2
(45) Date of Patent: Jul. 25, 2017

(54) LIQUID JET HEAD HAVING DRIVE ELECTRODES OF DIFFERENT DEPTHS ON EJECTION AND DUMMY CHANNELS

(71) Applicant: SII PRINTEK INC., Chiba-shi, Chiba (JP)

(72) Inventors: Toshimitsu Morooka, Chiba (JP); Satoshi Horiguchi, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/841,983

(22) Filed: Sep. 1, 2015

(65) Prior Publication Data

US 2016/0075133 A1 Mar. 17, 2016

(30) Foreign Application Priority Data

Sep. 12, 2014 (JP) ..... 2014-186438

(51) Int. Cl.
*B41J 2/16* (2006.01)
*B41J 2/14* (2006.01)

(52) U.S. Cl.
CPC ..... *B41J 2/1642* (2013.01); *B41J 2/14209* (2013.01); *B41J 2/1609* (2013.01); *B41J 2/1623* (2013.01); *B41J 2/1631* (2013.01); *B41J 2/1632* (2013.01); *B41J 2002/14491* (2013.01)

(58) Field of Classification Search
CPC .... B41J 2/1642; B41J 2/14209; B41J 2/1631; B41J 2/1609; B41J 2/1623; B41J 2/1632; B41J 2002/14491
See application file for complete search history.

(56) References Cited

U.S. PATENT DOCUMENTS

| | | | | |
|---|---|---|---|---|
| 5,432,540 | A * | 7/1995 | Hiraishi | B41J 2/1609 347/69 |
| 5,631,680 | A | 5/1997 | Sugahara | 347/69 |
| 6,106,106 | A * | 8/2000 | Nakazawa | B41J 2/14209 347/68 |
| 6,709,091 | B1 | 3/2004 | Takahashi | 347/71 |
| 6,722,035 | B1 | 4/2004 | Yoshimura | 29/890.1 |
| 2011/0292135 | A1* | 12/2011 | Koseki | B41J 2/14209 347/71 |

FOREIGN PATENT DOCUMENTS

| | | |
|---|---|---|
| EP | 2390094 | 11/2011 |
| GB | 2288765 | 11/1995 |
| GB | 2466880 | 7/2010 |
| GB | 2509584 | 7/2014 |
| GB | 2510029 | 7/2014 |
| JP | 7068752 | 3/1995 |
| JP | 10016216 | 1/1998 |
| JP | 10202871 | 8/1998 |
| JP | 2001334657 | 12/2001 |

* cited by examiner

*Primary Examiner* — Bradley Thies
(74) *Attorney, Agent, or Firm* — Adams & Wilks

(57) ABSTRACT

A liquid jet head includes ejection channels and dummy channels alternately arrayed across partitions to configure a channel row, and drive electrodes that are side surfaces of the partitions and are positioned from upper ends of the partitions in a depth direction, and an average depth of two drive electrodes positioned on facing side surfaces of the ejection channel is different from an average depth of two drive electrodes positioned on facing side surfaces of the dummy channel adjacent to the ejection channel.

13 Claims, 17 Drawing Sheets

LIQUID JET HEAD HAVING DRIVE ELECTRODES OF DIFFERENT DEPTHS ON EJECTION AND DUMMY CHANNELS

BACKGROUND

Technical Field

The present invention relates to a liquid jet head, a liquid jet apparatus, and a method of manufacturing a liquid jet head, which jets liquid droplets on a recording medium to perform recording.

Related Art

In recent years, liquid jet heads of an ink jet system, which eject ink droplets on a recording sheet or the like to record characters and figures, or which eject a liquid material on a surface of an element substrate to form a functional thin film, have been used. This system supplies a liquid such as the ink or the liquid material from a liquid tank to a channel of a liquid jet head through a supply tube, and applies pressure to the liquid in the channel to eject the liquid through a nozzle communicating into the channel, as droplets. In ejecting the droplets, the system moves the liquid jet head and the recording medium, and records the characters and the figures or forms the functional thin film or a three-dimensional structure having a predetermined shape.

As this sort of liquid jet head, a shear mode-type liquid jet head is known. The shear mode-type liquid jet head has ejection channels and dummy channels alternately formed in a surface of a piezoelectric substrate, and momentarily deforms partitions between the ejection channels and the dummy channels to eject liquid droplets through nozzles communicating into the ejection channels. In recent years, the liquid jet head is required to provide high-quality printing, and the volume of the liquid droplets to be ejected becomes small such as several picoliters. To stably eject such fine liquid droplets, efforts to decrease variation in a liquid droplet amount and ejection speed among the channels have been made.

For example, JP 2001-334657 A describes a shear mode-type liquid jet head. FIG. 17 is a perspective view of a liquid jet head 100 described in JP 2001-334657 A. FIGS. 18A and 18B are diagrams for describing characteristics of the liquid jet head 100. FIG. 18A is a diagram illustrating depths of electrodes 105 from right and left upper ends of channel walls 103, and FIG. 18B is a diagram illustrating an applied voltage. In the liquid jet head 100, the depths of the electrodes 105 for driving the channel wall 103 differs in each channel 104, and variation in ejection of liquid droplets occurs accordingly. Therefore, JP 2001-334657 A describes that the applied voltage is changed according to the depths of the electrodes 105 of each channel 104, so that the variation in ejection of liquid droplets is decreased.

SUMMARY

In JP 2001-334657 A, the applied voltage applied to the electrodes 105 of the channel wall 103 is continuously changed according to the position of the channel wall 103. Therefore, a large number of potential levels of a drive voltage is required, and a drive circuit becomes complicated. Further, if a film-forming device that can take a substantially large distance from a vapor deposition source with respect to the size of a base material 101 when the electrodes 105 are formed on the channel walls 103 by an oblique vapor deposition method, the depths of the electrodes 105 are unified. However, the size of the base material 101 becomes large with an increase in the number of nozzles, and it is therefore necessary to make a film-forming chamber large enough. Further, a complicated configuration is required for a deposition power source. As a result, the film-forming device becomes expensive and a manufacturing cost is elevated.

A liquid jet head of the present invention includes ejection channels and dummy channels alternately arrayed across partitions to configure a channel row, and drive electrodes that are positioned on side surfaces of the partitions, and positioned from upper ends of the partitions in a depth direction, wherein an average depth Tmc of two drive electrodes positioned on facing side surfaces of the ejection channel is different from an average depth Tmd of two drive electrodes positioned on facing side surfaces of the dummy channel adjacent to the ejection channel.

Further, the average depth Tmc and the average depth Tmd satisfy a relationship of formula (1):

$$Tmc > Tmd \quad (1).$$

Further, a groove width of the ejection channel is wider than a groove width of the dummy channel.

Further, the relationship of formula (1) is satisfied among the ejection channel and the dummy channels adjacent to both sides of the ejection channel.

Further, the relationship of formula (1) is satisfied among the ejection channel and the dummy channels positioned at both end sides of the channel row.

Further, the relationship of formula (1) is satisfied among all of the ejection channels and the dummy channels adjacent to one another of the channel row.

Further, the average depth Tmc and the average depth Tmd satisfy a relationship of formula (2):

$$Tmc < Tmd \quad (2).$$

Further, a groove width of the ejection channel is narrower than a groove width of the dummy channel.

Further, the relationship of formula (2) is satisfied among the ejection channel and the dummy channels adjacent to both sides of the ejection channel.

Further, the relationship of formula (2) is satisfied among the ejection channels and the dummy channels positioned at both end sides of the channel row.

Further, the relationship of formula (2) is satisfied among all of the ejection channels and the dummy channels adjacent to one another of the channel row.

Further, a depth of the drive electrode provided on one side surface of the dummy channel gradually becomes deeper as the dummy channel is positioned from one end to the other end of the channel row, and a depth of the drive electrode provided on the other side surface of the dummy channel gradually becomes shallower as the dummy channel is positioned from the one end to the other end of the channel row.

Further, a depth of the drive electrode provided on one side surface of the ejection channel gradually becomes deeper as the ejection channel is positioned from one end to the other end of the channel row, and a depth of the drive electrode provided on the other side surface of the ejection channel gradually becomes shallower as the ejection channel is positioned from the one end to the other end of the channel row.

A liquid jet apparatus of the present invention includes the liquid jet head according to any one of the above description, a movement mechanism configured to relatively move the liquid jet head and arecording medium, a liquid supply tube configured to supply a liquid to the liquid jet head, and a liquid tank configured to supply the liquid to the liquid supply tube.

A method of manufacturing a liquid jet head of the present invention includes a groove formation step of forming, on a surface of an actuator substrate, a groove array in which ejection grooves and non-ejection grooves are alternately arrayed, a first electrode material deposition step of depositing an electrode material on the surface of the actuator substrate, and, side surfaces of the ejection groove and the non-ejection groove by an oblique vapor deposition method, and a second electrode material deposition step of installing a mask that blocks either the non-ejection groove or the ejection groove, and depositing an electrode material on the surface of the actuator substrate, and the side surface of the ejection groove or the non-ejection groove by an oblique vapor deposition method, wherein an incident angle of the electrode material to a normal line of the surface of the actuator substrate in the second electrode material deposition step is smaller than an incident angle of the electrode material to the normal line of the surface of the actuator substrate in the first electrode material deposition step.

A method of manufacturing a liquid jet head of the present invention includes a groove formation step of forming, on a surface of an actuator substrate, a groove array in which ejection grooves and non-ejection grooves having a different groove width from the ejection grooves are alternately arrayed, and an electrode material deposition step of depositing an electrode material on the surface of the actuator substrate, and side surfaces of the ejection groove and the non-ejection groove by an oblique vapor deposition method.

A method of manufacturing a liquid jet head of the present invention includes a resin film pattern formation step of forming a pattern of a resin film on a surface of an actuator substrate, a groove formation step of forming, on the surface of the actuator substrate, a groove array in which ejection grooves and non-ejection grooves are alternately arrayed, and an electrode material deposition step of depositing an electrode material on the surface of the actuator substrate, and side surfaces of the ejection groove and the non-ejection groove by an oblique vapor deposition method, wherein the resin film pattern formation step leaves the resin film on either side of the non-ejection groove or the ejection groove, of a partition region between the ejection groove and the non-ejection groove, and removes the resin film from the other side.

Further, the groove formation step is a step of forming the ejection groove from one end to in front of the other end of the actuator substrate, and a cover plate bonding step of bonding a cover plate to the surface of the actuator substrate, and a nozzle plate adhesion step of causing a nozzle plate to adhere to an end surface of the actuator substrate are further included.

Further, a cover plate bonding step of bonding a cover plate to a back surface of the actuator substrate, and a nozzle plate adhesion step of causing a nozzle plate to adhere to the surface of the actuator substrate are further included, and the groove formation step includes an ejection groove formation step of forming the ejection groove in the actuator substrate, and a non-ejection groove formation step of forming the non-ejection groove in the actuator substrate, and the cover plate bonding step is performed after the ejection groove formation step, and the non-ejection groove formation step is performed after the resin film pattern formation step.

Further, the resin film pattern formation step leaves the resin film on a side of the non-ejection groove, and removes the resin film from a side of the ejection groove, of the partition region.

Further, a resin film removal step of removing the resin film from the surface of the actuator substrate, forming drive electrodes on side surfaces of the ejection groove and the non-ejection groove, and forming, on the surface of the actuator substrate, a common terminal electrically connected with the drive electrodes positioned on both side surfaces of the ejection groove, and an individual terminal electrically connected with the drive electrodes positioned on side surfaces at sides of the ejection groove, of two non-ejection grooves that sandwich the ejection groove are further included.

The liquid jet head of the present invention includes ejection channels and dummy channels alternately arrayed across partitions to configure a channel row, and drive electrodes that are side surfaces of the partitions, and positioned from upper ends of the partitions in a depth direction, and an average depth Tmc of two drive electrodes positioned on facing side surfaces of the ejection channel is different from an average depth Tmd of two drive electrodes positioned on facing side surfaces of the dummy channel adjacent to the ejection channel. Accordingly, variation in a displacement amount of both partitions of the ejection channel is decreased without using a large number of potential levels of a drive voltage, and recording quality is improved.

DETAILED DESCRIPTION

<Liquid Jet Head>

First Embodiment

Figure 1A:
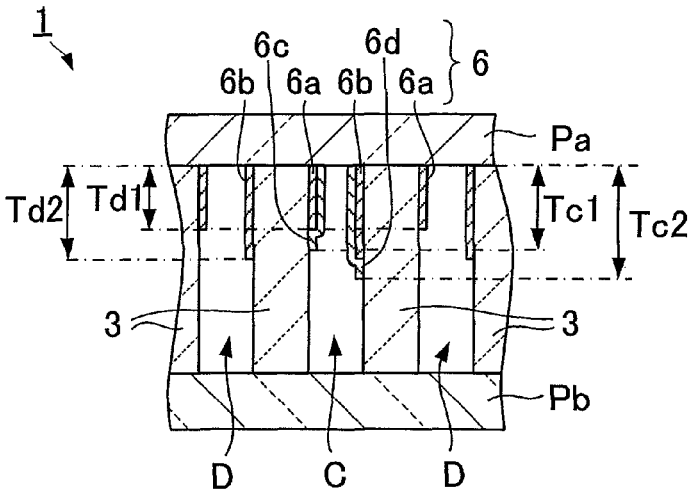
FIGS. 1A to 1C are explanatory diagrams of a liquid jet head according to a first embodiment of the present invention.
Figure 1B:
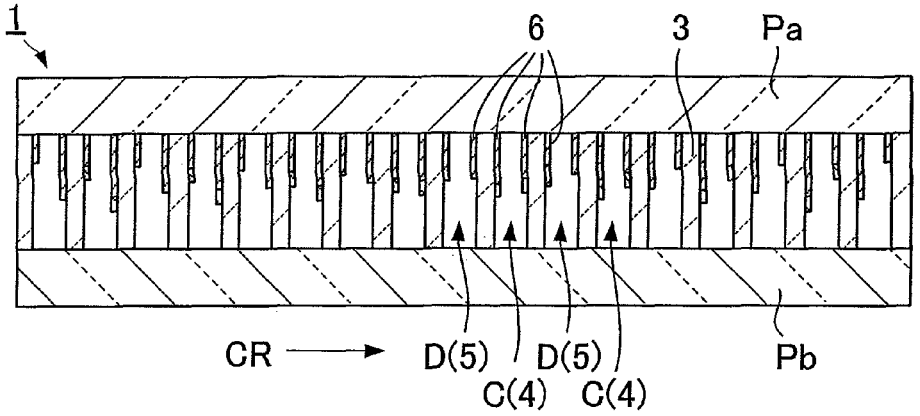
Figure 1C:
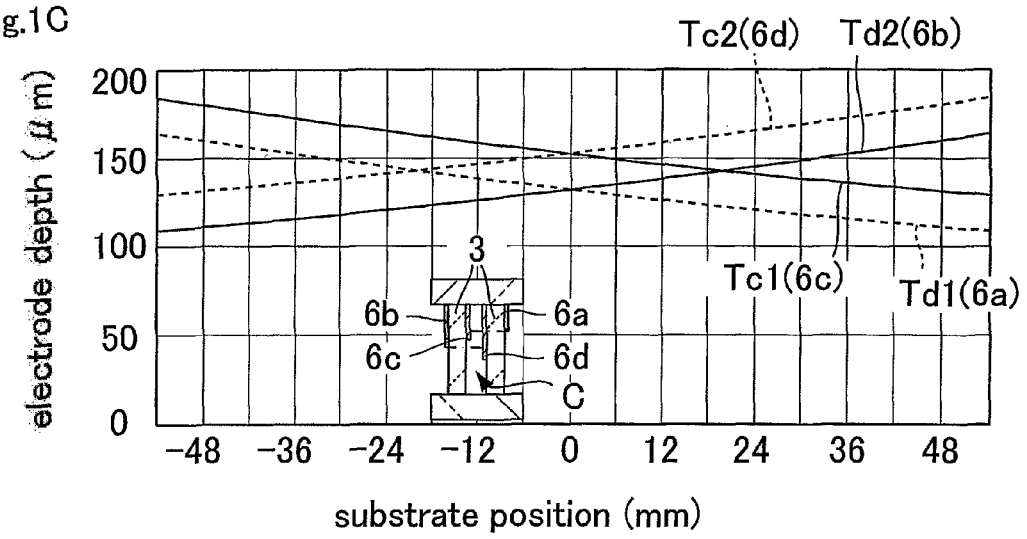

FIGS. 1A to 1C are explanatory diagrams of a liquid jet head 1 according to a first embodiment of the present invention. FIG. 1A is an explanatory diagram of drive electrodes 6 of dummy channels D that sandwich an ejection channel C, FIG. 1B is a cross-sectional schematic diagram of the liquid jet head 1 in a channel row CR direction, and FIG. 1C is a graph illustrating a relationship between a substrate position of a channel (the ejection channel C or the dummy channel D), and an electrode depth of the drive electrode 6.

As illustrated in FIG. 1B, the liquid jet head 1 includes ejection channels C and dummy channels D that are alternately arrayed across partitions 3 to configure a channel row CR, and drive electrodes 6 that are positioned on side surfaces of the partitions 3 and positioned in a depth direction from upper ends of the partitions 3. As illustrated, the drive electrodes 6 extend to a depth that does not reach the bottoms of the ejection channels C and the dummy channels D, i.e., the drive electrodes are spaced from the channel bottoms. Further, as illustrated in FIG. 1A, an average depth Tmc=(Tc1+Tc2)/2 of depths Tc1 and Tc2 of two drive electrodes 6 positioned on facing side surfaces of the ejection channel C is deeper than an average depth Tmd=(Td1+Td2)/2 of depths Td1 and Td2 of two drive electrodes 6 positioned on facing side surfaces of the dummy channel D adjacent to the ejection channel C. That is, a relationship of Tmc>Tmd (referred to as formula (1); the same applies to below) is satisfied. This relationship between the average depth Tmc of the two drive electrodes 6 of the ejection channel C and the average depth Tmd of the two drive electrodes 6 of the dummy channel D adjacent to the ejection channel C is satisfied among the ejection channel C and the dummy channels D adjacent to both sides of the ejection channel C. Further, this relationship between the average depth Tmc of the two drive electrodes 6 of the ejection channel C and the average depth Tmd of the two drive electrodes 6 of the dummy channel D adjacent to the ejection channel C is satisfied among all adjacent ejection channels C and dummy channels D of the channel row CR. Accordingly, variation in a displacement amount of both partitions 3 of the ejection channel C is decreased without using a large number of potential levels of a drive voltage, and recording quality can be improved.

Hereinafter, description will be specifically given. The ejection channel C is surrounded by right and left partitions 3, and an upper first substrate Pa and a lower second substrate Pb. Similarly, the dummy channel D is surrounded by right and left partitions 3, and the upper first substrate Pa and the lower second substrate Pb. The ejection channels C and the dummy channels D are adjacently and alternately arrayed, and configure the channel row CR. As the partition 3, a piezoelectric material, for example, a ceramic made of lead zirconate titanate (PZT) or barium titanate (BaTiO3) can be used. Polarization processing is upwardly or downwardly applied to the piezoelectric material in a uniform manner. Further, a so-called chevron-type piezoelectric material in which the polarization processing is applied at an approximately ½ depth in opposite directions can be used. As the first substrate Pa or the second substrate Pb, the same material as the piezoelectric material that configures the partition 3, or a different material can be used. For example, grind work is applied to a surface of an actuator substrate made of one sheet of the piezoelectric material with a dicing blade, and ejection grooves 4 for the ejection channels C and non-ejection grooves 5 for the dummy channels D are alternately formed across the partitions 3 and the actuator substrate remains on a bottom portion. This remaining actuator substrate is used as the second substrate Pb. The ejection channel C and the dummy channel D have a predetermined length in a depth direction of the sheet surface of 3 to 8 mm, for example, a channel width in the channel row CR direction of 20 to 100 ?m, and a channel height of 100 to 400 ?m. As the electrode 6, a conductive material made of a metal material or a semiconductor material is used. The electrode 6 is formed by an oblique vapor deposition method. For example, Ti, Ni, Al, Au, Ag, Si, C, Pt, Ta, Sn, In, or the like can be used. The ejection channel C and the dummy channel D illustrated in FIGS. 1A to 1C have the same width in the channel row CR direction.

Although details will be described below, the drive electrodes 6 are formed with a conductive material by an oblique vapor deposition method. In the present embodiment, oblique vapor deposition (first-time oblique vapor deposition) of the conductive material is performed from an obliquely right upper portion of an angle θ1 with respect to a normal line of the upper end surface of the partition 3, so that first drive electrodes 6*a* are formed on left-side surfaces of the ejection channels C and the dummy channels D, before the first substrate Pa is bonded to the upper end surfaces of the partitions 3. Further, oblique vapor deposition (second-time oblique vapor deposition) of the conductive material is performed from an obliquely left upper portion of the angle θ1 with respect to the normal line of the upper end surface of the partition 3, so that second drive electrodes 6*b* are formed on right-side surfaces of the ejection channels C and the dummy channels D. Next, blocking masks are installed on upper openings of the dummy channels D. The blocking masks are not installed on upper openings of the ejection channels C and are kept in an open state. Then, oblique vapor deposition (third-time oblique vapor deposition) of the conductive material is performed from an obliquely right upper portion of an angle θ2 with respect to the normal line of the upper end surface of the partition 3, the angle θ2 being smaller than the angle θ1, so that a third drive electrode 6*c* is formed deeper than the first drive electrode 6*a*, on the left-side surfaces of the ejection channels C. Further, oblique vapor deposition (fourth-time oblique vapor deposition) of the conductive material is performed from an obliquely left upper portion of the angle θ2 with respect to the normal line of the upper end surface of the partition 3, the angle θ2 being smaller than the angle θ1, so that a fourth drive electrode 6*d* is formed deeper than the second drive electrode 6*b*, on the right-side surfaces of the ejection channels C (see FIGS. 8A to 8D for the angles θ1 and θ2).

In the present embodiment, depths of the ejection channel C and the dummy channel D are 300 μm, depths of the drive electrodes 6*a* and 6*b* formed by the first-time and second-time oblique vapor deposition methods of each channel are about 130 μm, and depths of the drive electrodes 6*c* and 6*d* of the ejection channel C formed by the third-time and fourth-time oblique vapor deposition are about 150 μm, in a center (0 mm) of the substrate position. Note that, when a polarizing direction of the partition 3 is upwardly or downwardly uniform, it is favorable that the drive electrode 6 with a shallower electrode depth, of the two drive electrodes 6 formed on both-side surfaces of the partition 3, has a depth not exceeding ½ of the depth of the channel. If the drive electrode 6 with a shallower electrode depth exceeds ½ of the depth of the channel, deformation of the partition 3 is suppressed due to an electric field applied to a region exceeding the depth ½, and the suppression of the deformation causes variation in an ejection condition of liquid droplets.

FIG. 1C illustrates a relationship between the electrode depth of the drive electrode 6 formed by the four times of the oblique vapor deposition, and the substrate position of the channel. The horizontal axis represents the substrate position (unit mm) of the ejection channel C or the dummy channel D, and the vertical axis represents the electrode depth of the drive electrode 6. The graphs respectively represent the electrode depth Tc1 of the third drive electrode 6*c* of the ejection channel C, the electrode depth Tc2 of the fourth drive electrode 6*d* of the ejection channel C, the electrode depth Td1 of the first drive electrode 6*a* of the right dummy channel D, and the electrode depth Td2 of the second drive electrode 6*b* of the left dummy channel D. The first and third drive electrodes 6*a* and 6*c* positioned on the right-side surface of the partitions 3 are decreased in the electrode depth as the substrate position is shifted from left (−) to right (+). The second and fourth drive electrodes 6*b* and 6*d* positioned on the left-side surfaces of the partitions 3 are increased in the electrode depth as the substrate position is shifted from left (−) to right (+).

That is, the depth of the drive electrode 6 provided on one side surface of the dummy channel D gradually becomes deeper as the dummy channel D is positioned from one end to the other end of the channel row CR, and the depth of the drive electrode 6 provided on the other side surface of the dummy channel D gradually becomes shallower as the dummy channel D is positioned from the one end to the other end of the channel row CR. Similarly, the depth of the drive electrode 6 provided on one side surface of the ejection channel C gradually becomes deeper as the ejection channel C is positioned from one end to the other end of the channel row CR, and the depth of the drive electrode 6 provided on the other side surface of the ejection channel C gradually becomes shallower as the ejection channel C is positioned from the one end to the other end of the channel row CR. This is because the drive electrodes 6 are formed by the oblique vapor deposition method. Note that, in FIG. 1C, the graphs with the solid lines are the drive electrodes 6 (6*b* and 6*c*) on the left-side partitions 3, and the graphs with the broken lines are the drive electrodes 6 (6*a* and 6*d*) on the right-side partitions 3.

The partition 3 performs thickness slip deformation by application of a voltage to the drive electrodes 6 that sandwich the partition 3. A thickness slip deformation amount becomes larger as an applied area of the voltage applied to the partition 3 is broader. The applied area of the voltage applied to the partition 3 is determined according to an overlapping area of the two drive electrodes 6 that sandwich the partition 3. After all, the thickness slip deformation amount is determined with the drive electrode 6 with a shallower electrode depth, of the two drive electrodes 6 that sandwich the partition 3. Therefore, in the case illustrated in FIG. 1A, the thickness slip deformation amount of the left-side partition 3 of the ejection channel C is determined according to the third drive electrode 6*c*, and the thickness slip deformation amount of the right-side partition 3 is determined according to the first drive electrode 6*a*. That is, the shallower drive electrode 6 of the drive electrodes 6 of the partition 3 serves to have an effective electrode depth. Note that a deformation amount of the ejection channel C is expressed by a sum of the deformation amount of the left-side partition 3 and the deformation amount of the right-side partition 3.

Therefore, to decrease variation in the deformation amount of the ejection channels C, variation in the sum of the deformation amounts of the right and left partitions 3 of the ejection channels C is decreased. In other words, the deformation amount of the ejection channel C depends on a total value (average depth) of the electrode depth of the shallower drive electrode 6 of the left-side partition 3 and the electrode depth of the shallower drive electrode 6 of the right-side partition 3. Therefore, to decrease the variation in the deformation amount of the ejection channels C, the variation in the total value (average depth) is decreased.

By way of FIGS. 2 to 4, an effect of the case of FIG. 1C, in which the average depth Tmc=(Tc1+Tc2)/2 of the third and fourth drive electrodes 6*c* and 6*d* of the ejection channel C is formed deeper than the average depth Tmd=(Td1+Td2)/2 of the first and second drive electrodes 6*a* and 6*b* of the dummy channel D adjacent to the ejection channel C, will be described.

Figure 2:
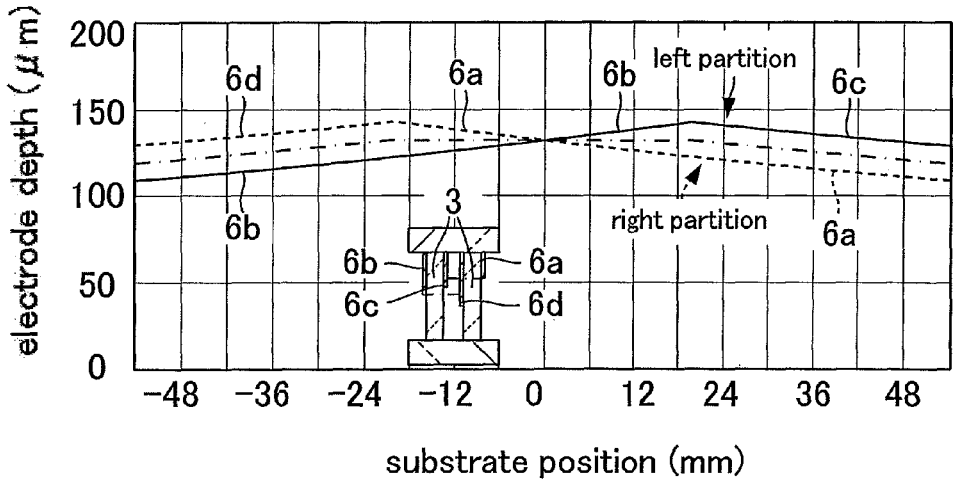
FIG. 2 is a graph in which a shallower drive electrode of two drive electrodes sandwiching a partition is plotted from the graph illustrating a relationship' between a substrate position and an electrode depth illustrated in FIG. 1C.

FIG. 2 illustrates graphs in which the drive electrode 6 with a shallower electrode depth, of the two drive electrodes 6 that sandwich the partition 3, is plotted from the graph illustrating a relationship between the substrate position and the electrode depth illustrated in FIG. 1C. The horizontal axis represents the substrate position of the channel, and the vertical axis represents the electrode depth. The graph with the solid line represents the shallower electrode depth of the left-side partition 3, and the graph with the broken line represents the shallower electrode depth of the right-side partition 3. The graph with the dot and dash line represents the average depth of the shallower electrode depth of the left-side partition 3 and the shallower electrode depth of the right-side partition 3. To decrease ejection variation of liquid droplets, it is desirable that the average electrode depth illustrated by the dot and dash line is constant regardless of the substrate position.

As illustrated in FIG. 2, in the present embodiment, the substrate position where the depth of the shallower drive electrode 6 of the left-side partition 3 becomes deepest (the graph with the solid line is maximized) and the substrate position where the depth of the shallower drive electrode 6 of the right-side partition 3 becomes deepest (the graph with the broken line is maximized) are shifted, and two peaks appear. In contrast, in a conventional method without being provided with the third and fourth drive electrodes 6*c* and 6*d*, there are only the first and second drive electrodes 6*a* and 6*b* (see FIG. 1A), and in a region where the substrate position of the channel is the left side (−), the second drive electrodes 6*b* are shallow in the partitions 3 at both sides of the ejection channel C (see FIG. 1C), and in a region where the substrate position of the channel is the right side (+), the first drive electrodes 6*a* are shallow in the partitions 3 at the both sides of the ejection channel C. Therefore, in the conventional method, the substrate position where the depth of the shallower drive electrode 6 of the left-side and right-side partitions 3 becomes deepest is the center (0), and the electrode depth becomes gradually shallower as the substrate position of the partition 3 is positioned to the both end sides (the − side and the + side). As can be easily understood from FIG. 2, the variation in the electrode depth of the effective drive electrode 6 that influences the displacement amount of the partition 3 is decreased in the drive electrode 6 of the present invention, and the ejection condition of liquid droplets can be equalized in relation to the substrate position of the ejection channel C, compared with the conventional drive electrode 6. Note that the two peak values are 150 μm or less, and are shallower than ½ of the depth 300 μm of the channel. Therefore, the partition 3 to which the polarization processing is upwardly or downwardly applied can be used.

Figure 3:
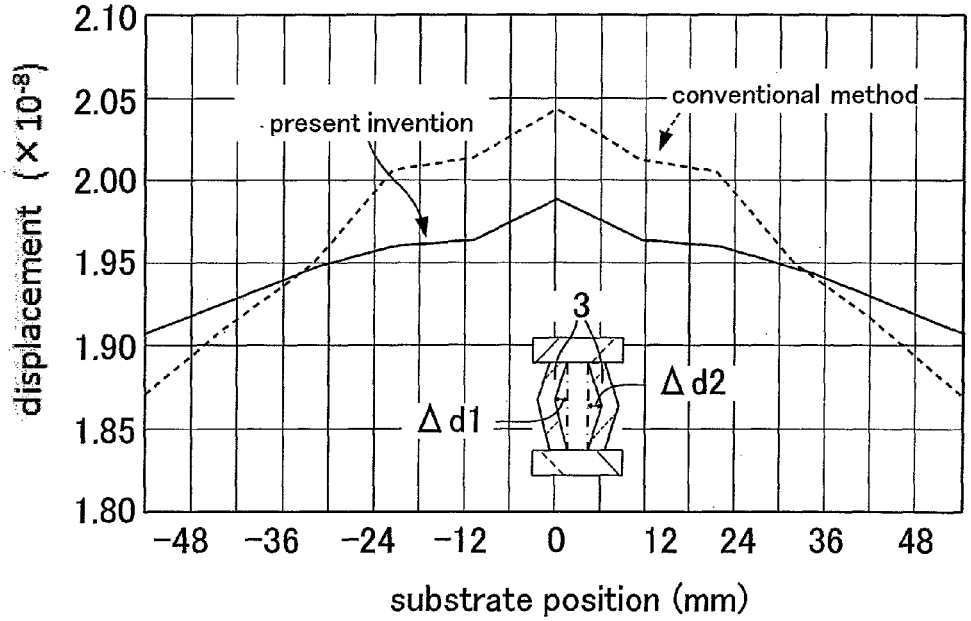
FIG. 3 is a graph illustrating a relationship between the substrate position of an ejection channel and maximum displacement of the partition.

FIG. 3 illustrates graphs illustrating a relationship between the substrate position of the ejection channel C and maximum displacement of the partition 3. The solid line is a simulation result of a case of using the drive electrodes 6 of the liquid jet head 1 of the present invention, and the broken line is a simulation result of a case of using drive electrodes 6 of a conventional liquid jet head 1. The vertical axis represents a maximum displacement amount of the partition 3 in the horizontal direction, and the horizontal axis represents the substrate position of the channel. Regarding the ejection channel C, a maximum displacement amount of the left-side partition 3 in the horizontal direction is Δd1, a maximum displacement amount of the right-side partition 3 in the horizontal direction is Δd2, and an average displacement amount Δdm=(Δd1+Δd2)/2.

As illustrated in FIG. 3, comparing the average displacement amount Δdm of the present invention and the average displacement amount Δdm of the conventional method, both of the average displacement amounts Δdm are largest in the center (0) of the substrate position and are gradually decreased toward both end directions (the − direction and the + direction) of the substrate position. However, while a difference between a maximum value and a minimum value of the average displacement amount Δdm of the drive electrodes 6 of the present invention is about $0.07\times10^{-8}$, which is small, a difference between a maximum value and a minimum value of the average displacement amount Δdm of the conventional drive electrodes 6 is $0.165\times10^{-8}$, which is more than twice as big as that of the present invention. That is, in the drive electrodes 6 of the present invention, the variation in the average displacement amount Δdm is substantially decreased compared with the conventional method, the ejection condition of liquid droplets can be equalized in relation to the substrate position of the ejection channel C, and the recording quality can be improved.

Figure 4:
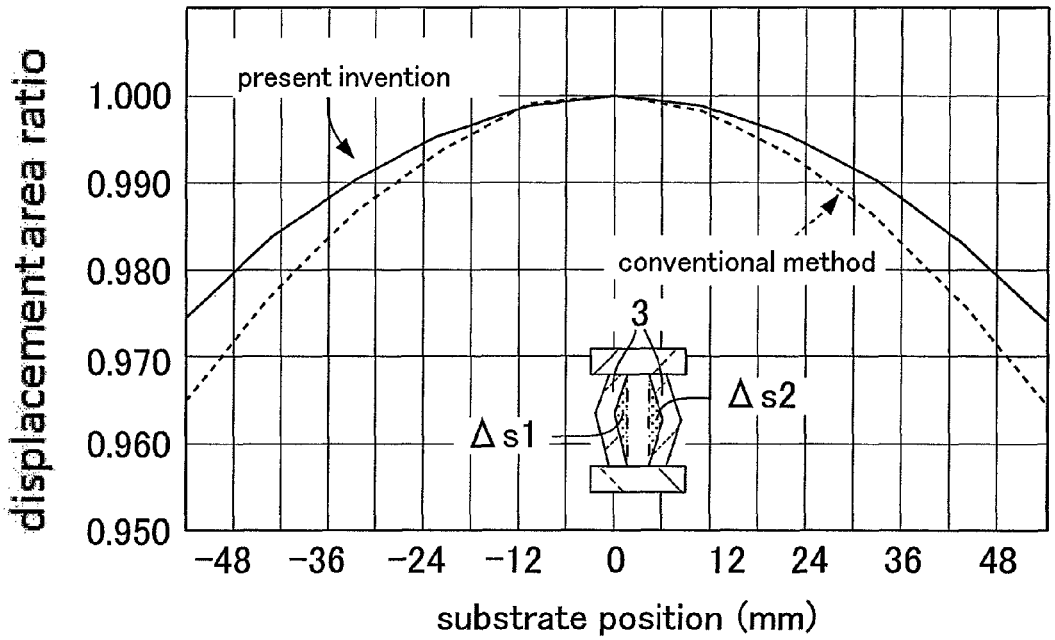
FIG. 4 is a graph illustrating a relationship between the substrate position of the ejection channel and a displacement area of the partition.

FIG. 4 illustrates graphs illustrating a relationship between the substrate position of the ejection channel C, and the displacement area of the partition 3. The solid line represents a simulation result of a case of using the drive electrodes 6 of the liquid jet head 1 of the present invention, and the broken line represents a simulation result of a case of using the drive electrodes 6 of the conventional liquid jet head 1. The vertical axis represents a displacement area ratio, and the horizontal axis represents the substrate position of the channel. The displacement area is an amount of the deformation amount of the partition 3 converted into a cross-sectional area of the ejection channel C. The displacement area ratio is standardized with the displacement area of the partition 3 in which the substrate position is the center. Regarding the ejection channel C, a displacement area of the left-side partition 3 is Δs1, a displacement area of the right-side partition 3 is Δs2, and an average displacement amount Δsm=(Δs1+Δs2)/2. As can be easily understood from FIG. 4, a difference between a maximum value and a minimum value of the average displacement amount Δsm of the drive electrodes 6 of the present invention is smaller than that of the conventional drive electrodes 6, and variation in the average deformation amount Δsm of the drive electrodes 6 of the present invention is decreased. For example, in the case of the ejection channels C positioned at both ends (−54 mm, and +54 mm) of the substrate position, the variation in the average deformation amount Δsm of the drive electrodes 6 of the present invention is improved by about 30%, compared with that of the conventional drive electrodes 6.

Note that, in the case of FIGS. 2 to 4, the average depth Tmc of the two drive electrodes 6 positioned on the facing side surfaces of the ejection channel C is deeper than the average depth Tmd of the two drive electrodes 6 positioned on the facing side surfaces of the dummy channel D adjacent to the ejection channel C (Tmc>Tmd) among all adjacent ejection channels C and dummy channels D of the channel row CR. Meanwhile, the values of all of the electrode depth, the displacement amount, and the displacement area ratio illustrated in FIGS. 2 to 4 are smallest in the vicinities of both ends of the substrate position, compared with the values in the vicinity of the center of the substrate position. Therefore, the ejection channels C positioned at both end sides (the − side and the + side) of the substrate position, that is, the ejection channels C positioned at the both end sides outside a predetermined position of the channel row CR and the dummy channels D adjacent to both sides of the ejection channels C satisfy the above-described relationship (Tmc>Tmd), and even if the drive electrodes 6 of the ejection channel C and the drive electrodes 6 of the dummy channels D positioned in another region of the substrate position, that is, in the vicinity of the center of the channel row CR are the same as the conventional ones, it is apparent that the variation in the depth of the electrode, the displacement amount, and the displacement area ratio is decreased. For example, when only the ejection channels C positioned at the − side outside −30 mm, and at the +side outside +30 mm satisfy the above-described relationship (Tmc>Tmd), the ejection variation of liquid droplets is decreased.

Further, in the present embodiment, the case in which the average depth Tmc of the two drive electrodes 6 positioned on the facing side surfaces of the ejection channel C is deeper than the average depth Tmd of the two drive electrodes 6 positioned on the facing side surfaces of the dummy channel D adjacent to the ejection channel C, that is, the case in which the relationship of Tmc>Tmd is satisfied has been described. Instead, a similar effect can be obtained in a case in which the average depth Tmc of the two drive electrodes 6 positioned on the facing side surfaces of the ejection channel C is shallower than the average depth Tmd of the two drive electrodes 6 positioned on the facing side surfaces of the dummy channel D adjacent to the ejection channel C, that is, in a case where a relationship of Tmc<Tmd (referred to as formula (2); the same applies to below) is satisfied. The relationship of Tmc<Tmd is satisfied among the ejection channel C and the dummy channels D adjacent to the both sides of the ejection channel C. Further, the relationship is satisfied among all adjacent ejection channels C and dummy channels D of the channel row CR. Further, the relationship is satisfied among the ejection channels C positioned at both end sides of the channel row CR and the dummy channels D adjacent to both sides of the ejection channels C. Further, in the present embodiment, the drive electrodes 6 are formed by the four times of oblique vapor deposition methods. However, instead, the drive electrodes 6 can be formed by two times of oblique vapor deposition methods. For example, the ejection channel C and the dummy channel D can be formed to have different groove widths.

Second Embodiment

Figure 5:
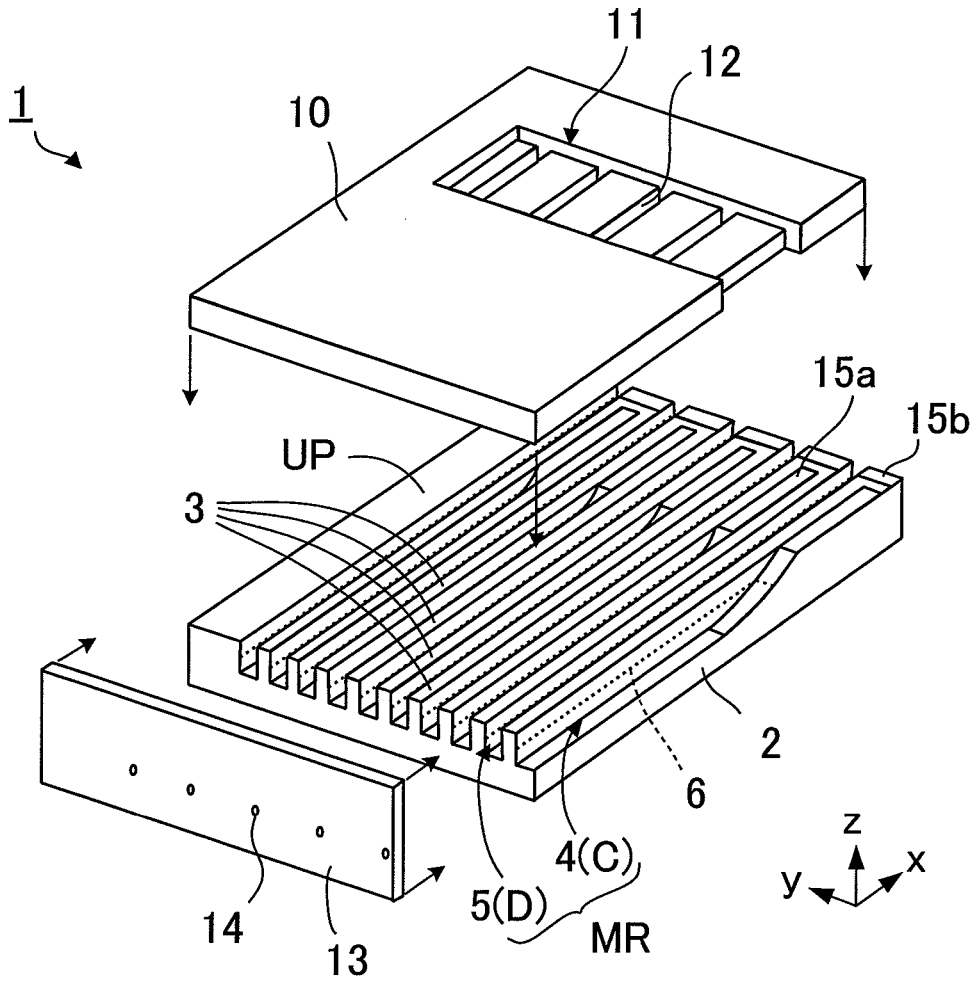
FIG. 5 is a schematic exploded perspective view of a liquid jet head according to a second embodiment of the present invention.

FIG. 5 is a schematic exploded perspective view of a liquid jet head 1 according to a second embodiment of the present invention. The liquid jet head 1 is an edge shoot-type liquid jet head. The same portion or a portion having the same function is denoted with the same reference symbol.

As illustrated in FIG. 5, the liquid jet head 1 includes an actuator substrate 2, a cover plate 10 bonded to an upper surface UP of the actuator substrate 2, and a nozzle plate 13 adhering to a front end surface of the actuator substrate 2. The actuator substrate 2 is formed of a piezoelectric material, and for example, a ceramic such as PZT or $BaTiO_3$ can be used. Polarization processing is upwardly or downwardly applied to the actuator substrate 2 in a uniform manner. The actuator substrate 2 includes, in the upper surface UP, ejection grooves 4 and non-ejection grooves 5 alternately arrayed across partitions 3 to configure a groove array MR, and drive electrodes 6 that are side surfaces of partitions 3, and are positioned from upper ends of the partitions 3 in a depth direction.

The ejection groove 4 extends from a front end to in front of a rear end of the actuator substrate 2, and the non-ejection groove 5 extends from the front end to the rear end of the actuator substrate 2 in a straight manner. The ejection groove 4 opens to the front end surface of the actuator substrate 2, and a side of the rear end forms a slope surface rising from a bottom surface to the upper surface UP of the ejection groove 4 and ends in the upper surface UP. The non-ejection groove 5 opens to the front end surface and a rear end surface of the actuator substrate 2. The actuator substrate 2 includes common terminals 15*a* and individual terminals 15*b* on the upper surface UP in the vicinity of the rear end. The common terminal 15*a* is electrically connected with drive electrodes 6 positioned on both side surfaces of the ejection groove 4, and is positioned at the side of the ejection groove 4. The individual terminal 15*b* electrically connects two drive electrodes 6 positioned on side surfaces at the sides of the ejection groove 4, of two non-ejection grooves 5 that sandwich the ejection groove 4, and is positioned at a rear end side in relation to the common terminal 15*a*.

The cover plate 10 includes a liquid chamber 11 and a plurality of slits 12 penetrating from a bottom surface of the liquid chamber 11 to the side of the actuator substrate 2. The cover plate 10 allows the common terminal 15*a*, the individual terminal 15*b*, and a rear-side part of the non-ejection groove 5 to be exposed, and is bonded to the upper surface UP of the actuator substrate 2. The slits 12 respectively communicate into the rear sides of the ejection grooves 4. Therefore, the liquid chamber 11 communicates into each of the ejection grooves 4 through each of the slits 12, and does not communicate into the non-ejection grooves 5. The nozzle plate 13 includes nozzles 14 in positions corresponding to the respective ejection grooves 4, and adheres to front end surfaces of the actuator substrate 2 and the cover plate 10. The nozzles 14 respectively communicate into the ejection grooves 4. The ejection groove 4 configures an ejection channel C by being surrounded by the cover plate 10 and the nozzle plate 13, and the non-ejection groove 5 configures a dummy channel D by being covered with the cover plate 10. As the cover plate 10, a PZT ceramic or a $BaTiO_3$ ceramic material, or a plastic material can be used. As the nozzle plate 13, a plastic material such as a polyimide film, or a metal material can be used.

Here, an average depth Tmc of two drive electrodes 6 positioned on facing side surfaces of the ejection groove 4 (ejection channel C) is deeper than an average depth Tmd of two drive electrodes 6 positioned on facing side surfaces of the non-ejection groove 5 (dummy channel D) adjacent to the ejection groove 4 (ejection channel C). That is, a relationship of Tmc>Tmd is satisfied. Further, the relationship of Tmc>Tmd is satisfied among the ejection groove 4, and the non-ejection grooves 5 adjacent to both sides of the ejection groove 4. Further, the relationship of Tmc>Tmd is satisfied among all of adjacent ejection grooves 4 and non-ejection grooves 5 of the groove array MR (channel row). Further, the relationship of Tmc>Tmd may be satisfied among the ejection grooves 4 and the non-ejection grooves 5 positioned at both end sides outside a predetermined position of the groove array MR.

The liquid jet head 1 is driven as follows. When a liquid is supplied to the liquid chamber 11, the liquid flows into the ejection grooves 4 through the respective slits 12. Then, when a drive voltage is applied to the common terminal 15*a* and the individual terminal 15*b*, first, two partitions 3 of the ejection groove 4 performs thickness slip deformation to increase the volume of the ejection groove 4 (ejection channel C), takes in the liquid from the liquid chamber 11, and then decreases the volume of the ejection groove 4 to eject liquid droplets through the nozzle 14. According to the configuration of the drive electrodes 6 of the present invention, variation in an electrode depth of an effective drive electrode 6 that influences a deformation amount of the partition 3 is decreased, and variation in an average displacement amount Δdm or an average deformation amount Δsm of two partitions 3 is decreased accordingly. As a result, an ejection condition of liquid droplets can be equalized regarding a substrate position of the ejection channel C.

Note that a similar result can be obtained in a case where the average depth Tmc of the two drive electrodes 6 positioned on the facing side surfaces of the ejection channel C is shallower than the average depth Tmd of two drive electrodes 6 positioned on facing side surfaces of the dummy channel D adjacent to the ejection channel C, that is, in a case where a relationship of Tmc<Tmd is satisfied, which has been described in the first embodiment.

Third Embodiment

Figure 6A:
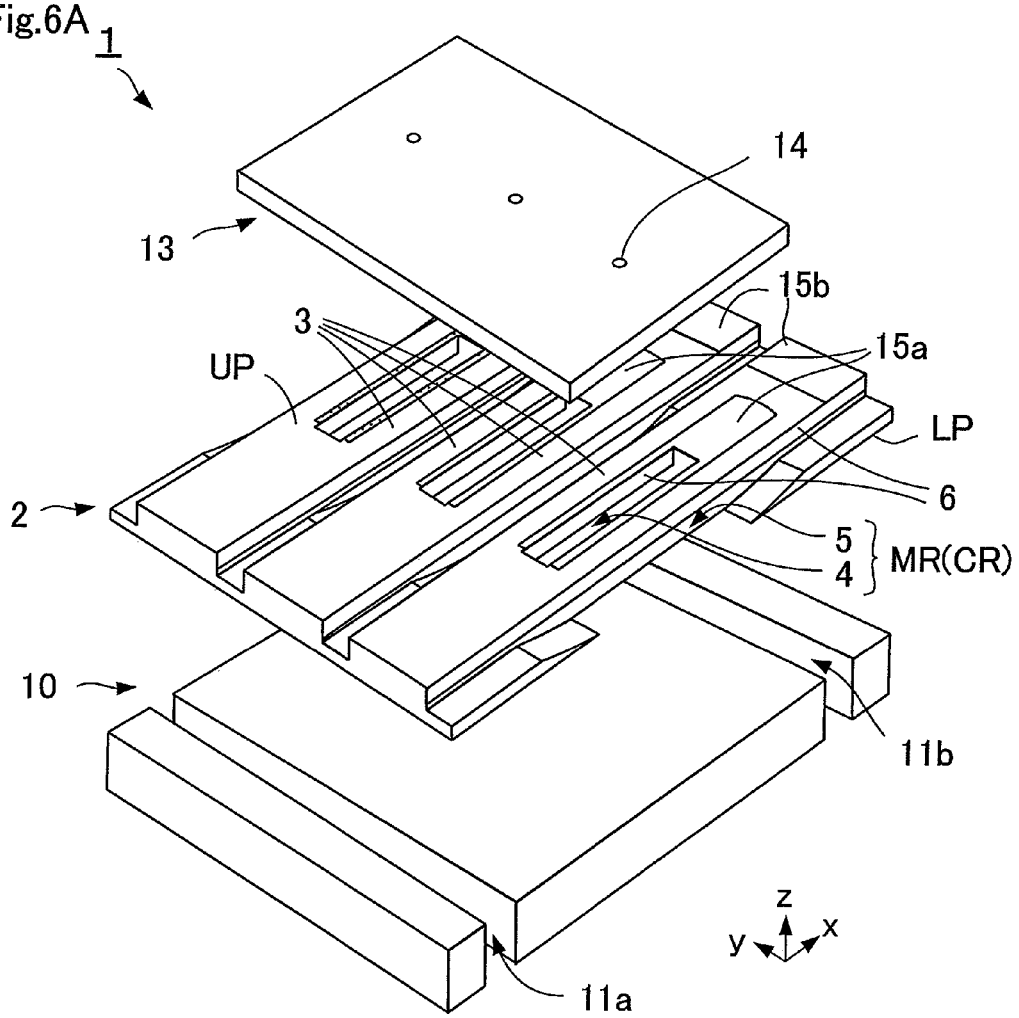
FIGS. 6A and 6B are explanatory diagrams of a liquid jet head according to a third embodiment of the present invention.
Figure 6B:
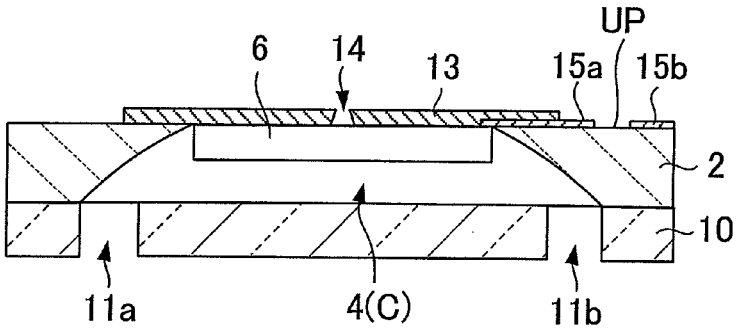

FIGS. 6A and 6B are explanatory diagrams of a liquid jet head 1 according to a third embodiment of the present invention. FIG. 6A is a perspective exploded perspective view of the liquid jet head 1, and FIG. 6B is a cross-sectional schematic diagram of an ejection groove 4. The liquid jet head 1 is a side shoot-type liquid jet head. The same portion or a portion having the same function is denoted with the same reference symbol.

As illustrated in FIGS. 6A and 6B, the liquid jet head 1 includes an actuator substrate 2, a nozzle plate 13 adhering to an upper surface UP of the actuator substrate 2, and a cover plate 10 bonded to a lower surface LP of the actuator substrate 2. The actuator substrate 2 includes ejection grooves 4 and non-ejection grooves 5 alternately arrayed across partitions 3 to configure a groove array MR, and drive electrodes 6 that are side surfaces of partitions 3 and positioned from upper ends of the partitions 3 in a depth direction. The ejection grooves 4 and the non-ejection grooves 5 are long and narrow in an x direction (groove direction), and are alternately arrayed in a y direction to configure the groove array MR (channel row CR). The ejection groove 4 and the non-ejection groove 5 penetrate in a plate thickness direction of the actuator substrate 2. The ejection groove 4 extends from in front of one end to in front of the other end of the actuator substrate 2 in the x direction. The ejection groove 4 has a central portion that opens in the x direction of the upper surface UP with a long and narrow shape, and both end portions that form a slope surface tapering from the upper surface UP to the lower surface LP. The non-ejection groove 5 extends from one end to the other end of the actuator substrate 2 in the groove direction. The non-ejection groove 5 includes a central portion having an upside-down shape of the ejection groove 4, and both end portions having a fixed depth from the upper surface UP. That is, the non-ejection groove 5 opens from the one end to the other end of the upper surface UP with the long and narrow shape. Drive electrodes 6 on the both side surfaces of the ejection groove 4 are positioned corresponding to the opening portion of the ejection groove 4, which open to the upper surface UP.

The actuator substrate 2 includes common terminals 15*a* and individual terminals 15*b* on the upper surface UP in the vicinity of one end in the x direction. The common terminal 15*a* is positioned in the vicinity of the opening portion of the ejection groove 4, and is electrically connected with the drive electrodes 6 positioned on the both side surfaces of the ejection groove 4 through a wire 16 (not illustrated) extending in the groove direction along the opening portion of the ejection groove 4. The individual terminal 15*b* is positioned closer to the other end side than the common terminal 15*a* is, and electrically connects two drive electrodes 6 positioned on side surfaces at the sides of the ejection groove 4, of two non-ejection grooves 5 that sandwich the ejection groove 4.

The cover plate 10 includes two liquid chambers 11*a* and 11*b*. One liquid chamber 11*a* communicates into one end portions of the ejection grooves 4, and the other liquid chamber 11*b* communicates into the other end portions of the ejection grooves 4. The non-ejection grooves 5 do not open to opening regions at the side of the actuator substrate 2, to which the two liquid chambers 11*a* and 11*b* open. Therefore, it is not necessary to provide slits in the two liquid chambers 11*a* and 11*b*. The nozzle plate 13 includes nozzles 14. The nozzle plate 13 adheres to the upper surface UP of the actuator substrate 2 to block the opening portions of the ejection grooves 4 and to allow the common terminals 15*a* and the individual terminals 15*b* to be exposed. The nozzle 14 communicates into the ejection groove 4 that opens to the upper surface UP. The ejection groove 4 configures an ejection channel C by being surrounded by the cover plate 10 and the nozzle plate 13, and the non-ejection groove 5 configures a dummy channel D by being covered with the cover plate 10 and the nozzle plate 13. The groove array MR arrayed in the y direction configures the channel row CR.

As the actuator substrate 2, a ceramic such as PZT or $BaTiO_3$ can be used. As the cover plate 10, a PZT ceramic, another ceramic material, or a plastic material can be used. As the nozzle plate 13, a plastic material such as polyimide film or a metal material can be used. As the electrode 6, a conductive material made of a metal material or a semiconductor material is used, the electrode 6 is formed by an oblique vapor deposition method. For example, Ti, Ni, Al, Au, Ag, Si, C, Pt, Ta, Sn, In, or the like can be used. The length of the channel is 3 to 8 mm in the x direction, the width of the channel is 20 to 100 μm, and a height h of the channel is 100 to 400 μm.

Here, an average depth Tmc of two drive electrodes 6 positioned on facing side surfaces of the ejection groove 4 (ejection channel C) is deeper than an average depth Tmd of the two drive electrodes 6 positioned on facing side surfaces of the non-ejection groove 5 (dummy channel D) adjacent to the ejection groove 4 (ejection channel C). That is, a relationship of Tmc>Tmd is satisfied. Further, the relationship of Tmc>Tmd is satisfied among the ejection groove 4 and the non-ejection grooves 5 adjacent to both sides of the ejection groove 4. Further, the relationship of Tmc>Tmd is satisfied among all of adjacent ejection grooves 4 and the non-ejection grooves 5 of the groove array (channel row CR). Further, the relationship of Tmc>Tmd may be satisfied among the ejection grooves 4 and the non-ejection grooves 5 positioned at both end sides outside a predetermined position of the groove array MR.

The liquid jet head 1 is driven as follows. A liquid is supplied from an outside to the liquid chamber 11*a* (or the liquid chamber 11*b*), and fills the liquid in the ejection groove 4 (ejection channels C). Further, the liquid flows out from the ejection grooves 4 into the liquid chamber 11*b* (or the liquid chamber 11*a*), and is discharged from the liquid chamber 11*b* (or the liquid chamber 11*a*) to the outside. That is, the liquid is circulated. Then, when a drive voltage is applied between the common terminal 15*a* and the individual terminal 15*b*, first, two partitions 3 of the ejection groove 4 perform thickness slip deformation to increase the volume of the ejection channel C (ejection groove 4), and the liquid is taken in from the liquid chamber 11*a* or 11*b*. Next, the volume of the ejection channel C is decreased, and liquid droplets are ejected through the nozzle 14. According to the configuration of the drive electrodes 6 of the present invention, variation in an electrode depth of an effective drive electrode 6 that influences a deformation amount of the partitions 3 is decreased, and an average displacement amount Δdm or an average deformation amount Δsm of the two partitions 3 is decreased, accordingly. As a result, an ejection condition of liquid droplets is equalized regarding the substrate position of the ejection channel C, and recording quality can be improved.

Note that a similar effect can be obtained in a case where the average depth Tmc of the two drive electrodes 6 positioned on the facing side surfaces of the ejection channel C is shallower than the average depth Tmd of the two drive electrodes 6 positioned on the facing side surfaces of the dummy channel D adjacent to the ejection channel C, that is, in a case where the relationship of Tmc<Tmd is satisfied, which has been described in the first embodiment.

<Method of Manufacturing Liquid Jet Head>

Fourth Embodiment

Figure 7:
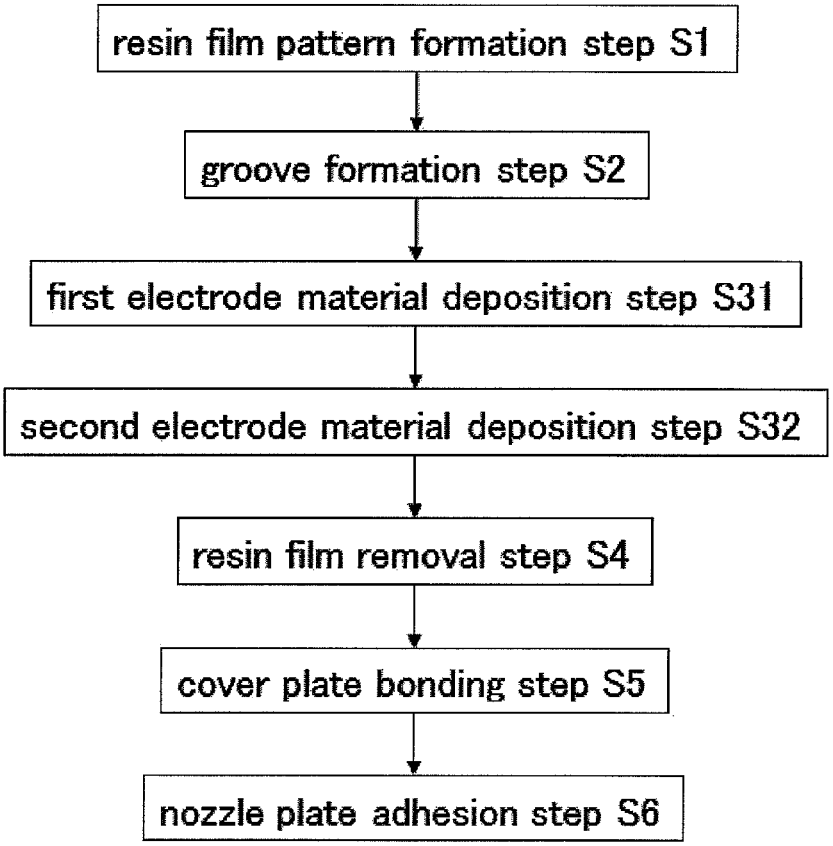
FIG. 7 is a flowchart of a method of manufacturing a liquid jet head according to a fourth embodiment of the present invention.
Figure 8A:
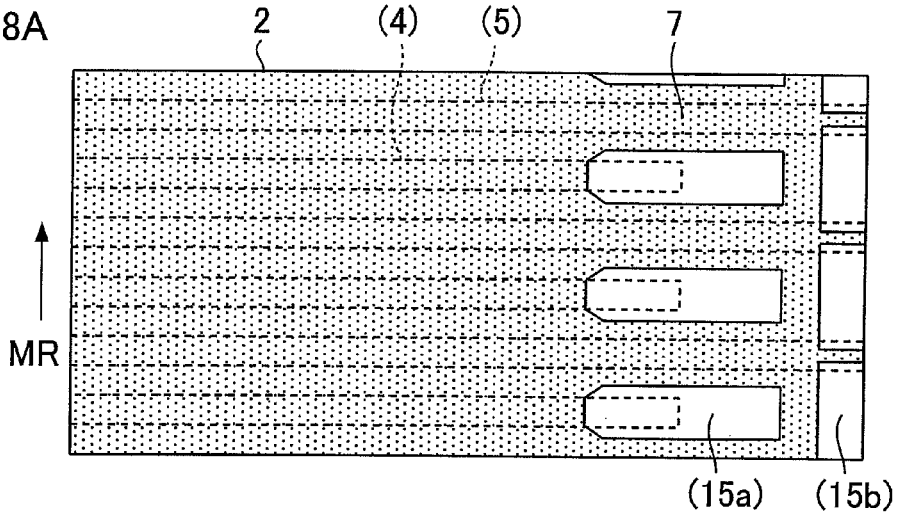
FIGS. 8A to 8D are explanatory diagrams of the method of manufacturing a liquid jet head according to the fourth embodiment of the present invention.
Figure 8B:
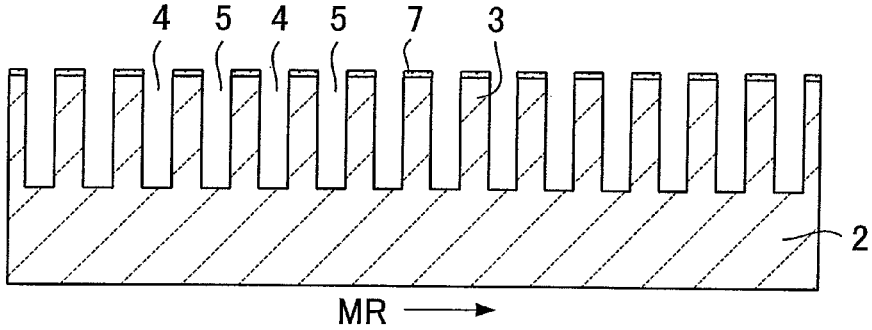
Figure 8C:
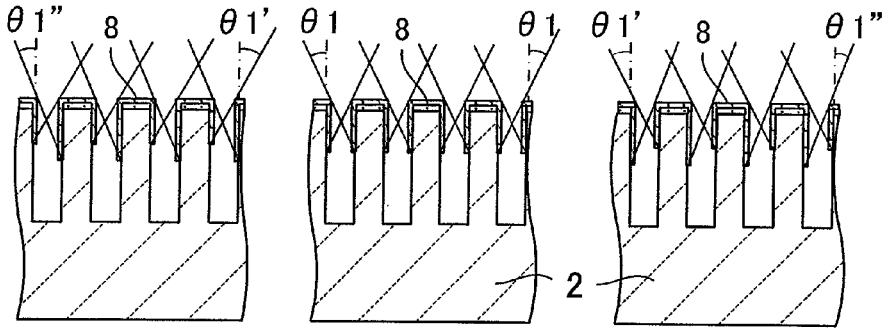
Figure 8D:
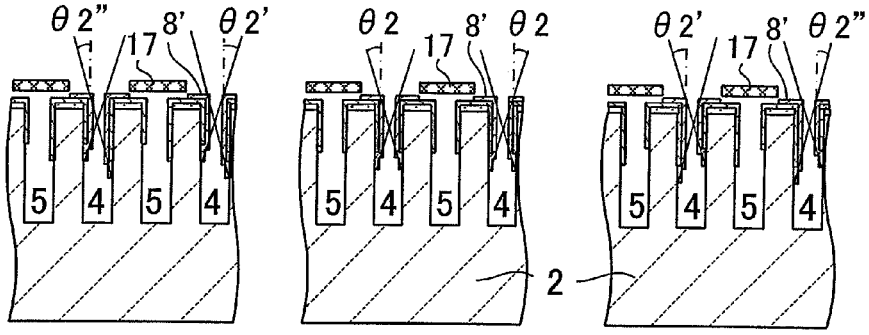
Figure 9A:
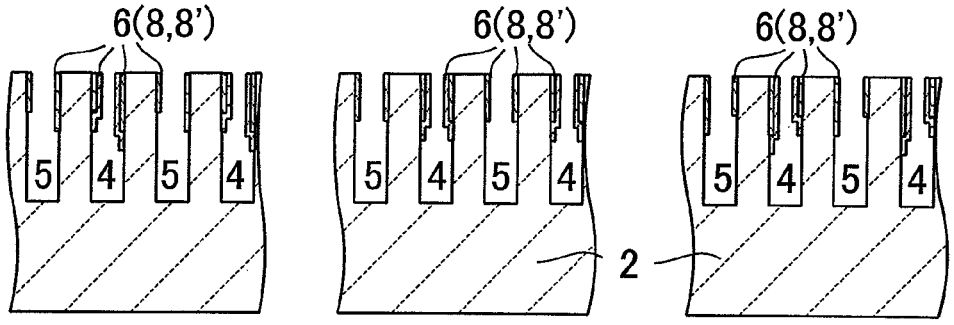
FIGS. 9A to 9C are explanatory diagrams of the method of manufacturing a liquid jet head according to the fourth embodiment of the present invention.
Figure 9B:
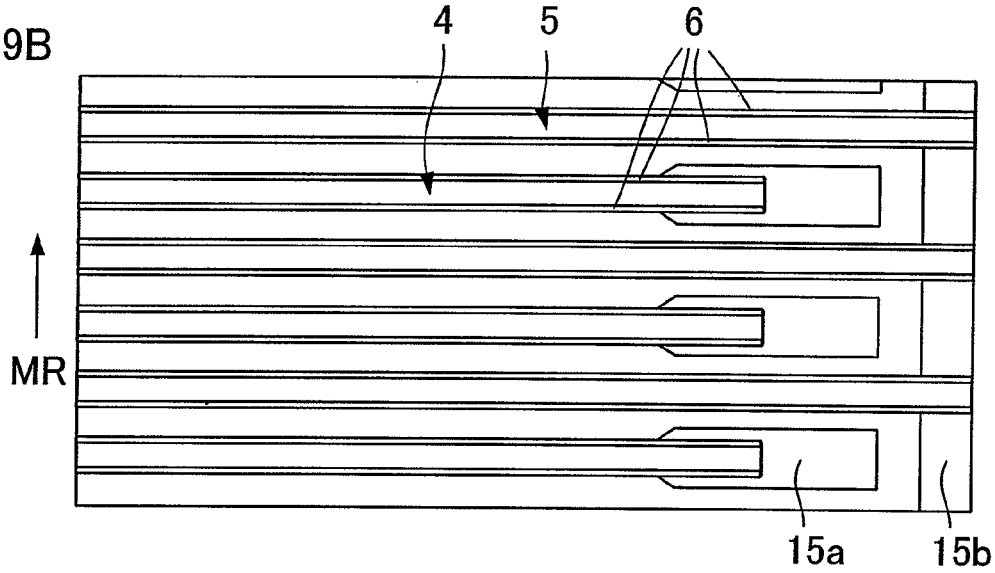
Figure 9C:
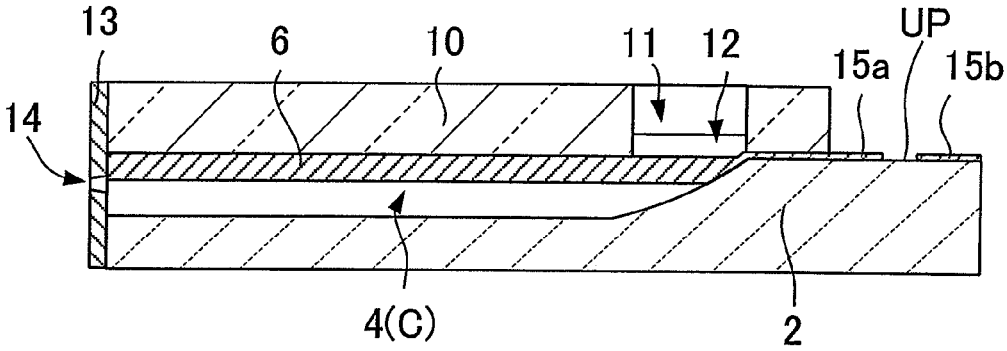

FIGS. 7 to 9C are explanatory diagrams of a method of manufacturing a liquid jet head 1 according to a fourth embodiment of the present invention. FIG. 7 is a flowchart of a method of manufacturing a liquid jet head 1. FIGS. 8A to 9C are explanatory diagrams of the method of manufacturing a liquid jet head 1. FIG. 8A is a schematic diagram of an upper surface of an actuator substrate 2, and FIGS. 8B to 8D are cross-sectional schematic diagrams of the actuator substrate 2 in a groove array MR direction. FIG. 9A is a cross-sectional schematic diagram of the actuator substrate 2 in the groove array MR, FIG. 9B is a schematic diagram of the upper surface of the actuator substrate 2, and FIG. 9C is a cross-sectional schematic diagram of an ejection groove 4 of the liquid jet head 1 in a groove direction. The same portion or a portion having the same function is denoted with the same reference symbol.

A basic method of manufacturing the liquid jet head 1 according to the fourth embodiment includes a groove formation step S2 of forming a groove array in which ejection grooves 4 and non-ejection grooves 5 are alternately arrayed on a surface (upper surface UP) of the actuator substrate 2, a first electrode material deposition step S31 of depositing an electrode material by a first oblique vapor deposition method, and a second electrode material deposition step S32 of depositing an electrode material by a second oblique vapor deposition method. The groove formation step S2 forms the groove array MR in which the ejection grooves 4 and the non-ejection grooves 5 are alternately arrayed, on the surface of the actuator substrate 2. The first electrode material deposition step S31 deposits the electrode material on the surface of the actuator substrate 2, and side surfaces of the ejection grooves 4 and the non-ejection grooves 5 by the first oblique vapor deposition method. The second electrode material deposition step S32 installs masks 17 that block either the non-ejection grooves 5 or the ejection grooves 4, and deposits the electrode material on the surface of the actuator substrate 2 and the side surfaces of the ejection grooves 4 and the non-ejection grooves 5 by the second oblique vapor deposition method. An incident angle θ2 of the electrode material to a normal line of the surface of the actuator substrate 2 in the second oblique vapor deposition method is smaller than an incident angle θ1 of the electrode material to the normal line of the surface of the actuator substrate 2 in the first oblique vapor deposition method.

As a result, an average depth of two drive electrodes 6 positioned on facing side surfaces of the ejection groove 4 (or the non-ejection groove 5) is deeper than an average depth of two drive electrodes 6 positioned on facing side surfaces of the non-ejection groove 5 (or the ejection groove 4) adjacent to the ejection groove 4 (or the non-ejection groove 5). This relationship is satisfied among the ejection groove 4, and the non-ejection grooves 5 adjacent to the ejection groove 4. Further, this relationship is satisfied among all of the ejection grooves 4 and the non-ejection grooves 5 of the groove array MR. As a result, as described in the first embodiment, dependence of an electrode depth of an effective drive electrode 6 of the partition 3 on a substrate position is decreased, and variation in an average displacement amount Δdm or an average deformation amount Δsm of the two partitions 3 is decreased, and an ejection condition of droplets of the ejection channel C is equalized.

Hereinafter, specific description will be given using FIGS. 7 to 9C. As illustrated in FIGS. 7 and 8A, in a resin film pattern formation step S1, a pattern of a resin film 7 is formed on the surface of the actuator substrate 2. As the actuator substrate 2, a piezoelectric material such as a PZT ceramic or a $BaTiO_3$ ceramic is used, for example. The pattern of the resin film 7 is formed such that a photosensitive resin film, for example, a resist film adheres to an upper surface UP of the actuator substrate 2, and the pattern is formed by a photolithography step. In the present embodiment, the resin film 7 is removed from the regions that are to serve as common terminals 15*a* and individual terminals 15*b*.

Next, as illustrated in FIGS. 7 and 8B, in the groove formation step S2, the groove array MR in which the ejection grooves 4 and the non-ejection grooves 5 are alternately arrayed across the partitions 3 is formed in the surface of the actuator substrate 2. The ejection grooves 4 and the non-ejection grooves 5 can be formed by being ground using a dicing blade in which abrasive grains for grinding such as diamond are embedded in an external periphery. The ejection grooves 4 and the non-ejection grooves 5 have a groove width of 20 to 100 μm and a groove depth of 100 to 400 μm, and can be formed to have the same groove width.

Next, as illustrated in FIGS. 7 and 8C, in the first electrode material deposition step S31, the electrode material is deposited on the surface of the actuator substrate 2 and the side surfaces of the ejection grooves 4 and the non-ejection grooves 5 by the first oblique vapor deposition method. Note that the central diagram of FIG. 8C is a cross-sectional schematic diagram of a central position of the groove array MR, the left diagram is a cross-sectional schematic diagram of a left position of the groove array MR, and the right diagram is a cross-sectional schematic diagram of a right position of the groove array MR. In the first oblique vapor deposition method, first-time oblique vapor deposition of a conductive material is performed from an obliquely right upper portion inclined by an angle θ1 in a groove array MR direction with respect to a normal line of the surface of the actuator substrate 2. Next, second-time oblique vapor deposition is performed by being rotated by 180° around the normal line in the center of the actuator substrate 2 as a central axis. In the drawing, left oblique vapor deposition being inclined by the angle θ1 in the groove array MR direction with respect to the normal line is performed. At this time, the inclined angle is changed according to the positions of the ejection groove 4 and the non-ejection groove 5 in the groove array MR, and the inclined angle satisfies a relationship of θ1'>θ1>θ1". Therefore, the depths of electrodes 8 on left-side side surfaces of respective grooves gradually become deeper as the positions of the ejection groove 4 and the non-ejection groove 5 are shifted from left to right of the groove array MR, and the depths of electrodes 8 on right-side side surfaces gradually become shallower. Note that the ejection groove 4 and the non-ejection groove 5 positioned in the center of the groove array MR have equal depths of the electrodes 8 on the both side surfaces.

Next, as illustrated in FIGS. 7 and 8D, the masks 17 that block the non-ejection grooves 5 are installed on upper openings of the non-ejection grooves 5, and deposits the electrode material on the surface of the actuator substrate 2 and the side surfaces of the ejection grooves 4 and the non-ejection grooves 5 by the second oblique vapor deposition method, in the second electrode material deposition step S32. In the second oblique vapor deposition method, the incident angle (inclined angle θ2) of the electrode material with respect to the normal line of the surface of the actuator substrate 2 is smaller than the incident angle (inclined angle θ1) of the electrode material in the first oblique vapor deposition method. Therefore, electrodes 8' can be formed deeper than the depth of the electrode 8 in the first oblique vapor deposition method, on both side surfaces of the ejection groove 4. In the second oblique vapor deposition method, similarly to the first oblique vapor deposition method, a relationship of θ2'>θ2>θ2" is satisfied. Note that, in the second electrode material deposition step S32, a mask is installed on a central portion of the groove array MR, and the electrode material may be deposited only on both end sides outside a predetermined position of the groove array MR. In this case, as described in the first embodiment, the relationship of Tmc>Tmd is satisfied among the ejection grooves 4 and the non-ejection grooves 5 positioned at the both end sides outside the predetermined position of the groove array MR.

Next, as illustrated in FIGS. 7, and 9A and 9B, in a resin film removal step S4, the resin film 7 is removed, and the conductive material deposited on an upper surface of the resin film 7 is removed at the same time (lift-off method). As a result, the electrodes 8 or 8' remain on the both side surfaces of the ejection grooves 4 and the non-ejection grooves 5, as the drive electrodes 6, and the electrodes 8 and 8' on the upper surface UP of the actuator substrate 2 remain as the common terminals 15*a* and the individual terminals 15*b*. Therefore, similarly to the description in the first embodiment, the average depth (Tmc) of depths Tc1 and Tc2 of the two drive electrodes 6 positioned on the facing side surfaces of the ejection groove 4 (ejection channel C) is deeper than the average depth (Tmd) of the depths of the two drive electrodes 6 positioned on the facing side surfaces of the non-ejection groove 5 (dummy channel D) adjacent to the ejection groove 4 (ejection channel C). That is, the relationship of Tmc>Tmd is satisfied. This relationship between the average depth Tmc of the two drive electrodes 6 of the ejection groove 4 (ejection channel C), and the average depth Tmd of the two drive electrodes 6 of the non-ejection groove 5 (dummy channel D) adjacent to the ejection groove 4 is satisfied among the ejection groove 4 and the non-ejection grooves 5 adjacent to both sides of the ejection groove 4. Further, this relationship is satisfied among all adjacent ejection grooves 4 and non-ejection grooves 5 of the groove array MR (channel row CR).

Next, as illustrated in FIGS. 7 and 9C, in a cover plate bonding step S5, the cover plate 10 is bonded to the upper surface UP (surface) of the actuator substrate 2. The cover plate 10 includes a liquid chamber 11 and a plurality of slits 12 penetrating from a bottom surface of the liquid chamber 11 to the side of the actuator substrate 2. The slits 12 respectively communicate into the other-side end portions of the ejection grooves 4. Next, in a nozzle plate adhesion step S6, the nozzle plate 13 adheres to the front end surfaces of the actuator substrate 2 and the cover plate 10. The nozzle plate 13 includes a plurality of nozzles 14, and the nozzles 14 respectively communicate into the ejection grooves 4 opening to the front end surface of the actuator substrate 2. The ejection groove 4, the cover plate 10, and the nozzle plate 13 configure the ejection channel C. The non-ejection groove 5 and the cover plate 10 configure the dummy channel D. In this way, the liquid jet head 1 illustrated in FIG. 5 can be manufactured. Accordingly, the variation in the deformation amount of both partitions 3 of the ejection channel C can be decreased, and the recording quality can be improved.

Note that the electrode material deposition step may be performed such that the second electrode material deposition step S32 is performed first, and then the first electrode material deposition step S31 is performed. Further, a similar effect can be obtained by forming the liquid jet head 1 such that the average depth Tmc of the drive electrodes 6 formed on two side surfaces of the ejection groove 4 is shallower than the average depth Tmd of the two drive electrodes 6 positioned on the facing side surfaces of the non-ejection groove 5 adjacent to the ejection groove 4, and the relationship of Tmc<Tmd is satisfied. The relationship of Tmc<Tmd is satisfied among the ejection channel C and the dummy channel D adjacent to both sides of the ejection channel C. Further, the relationship of Tmc<Tmd is satisfied among all adjacent ejection channels C and dummy channels D of the channel row CR.

Fifth Embodiment

Figure 10:
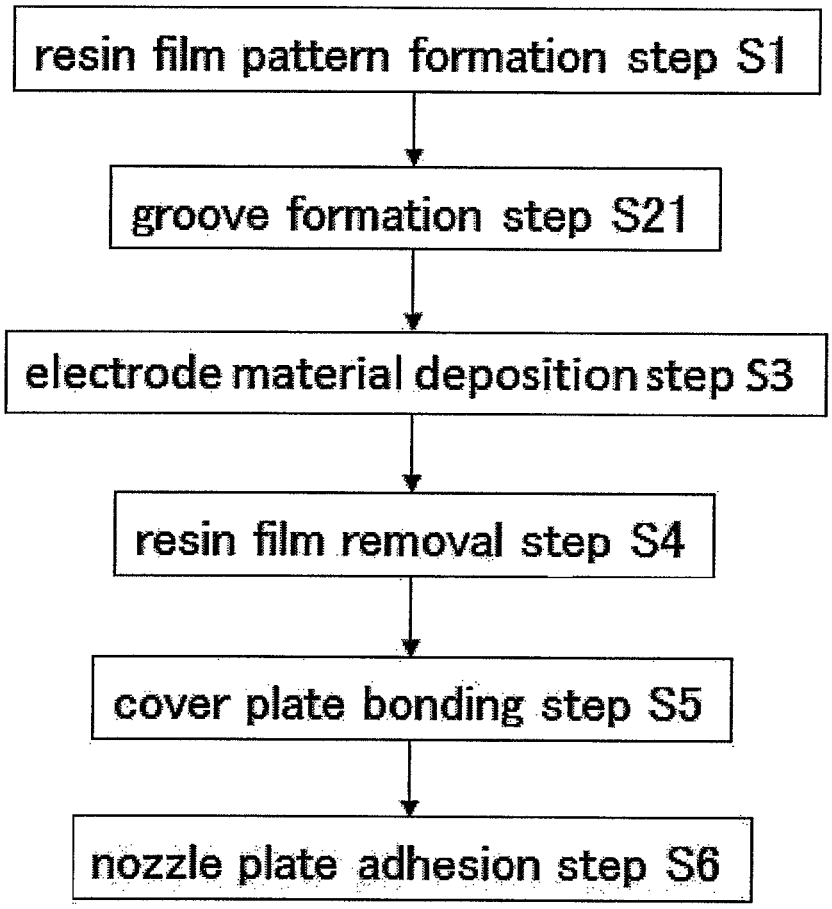
FIG. 10 is a flowchart of a method of manufacturing a liquid jet head according to a fifth embodiment of the present invention.
Figure 11A:
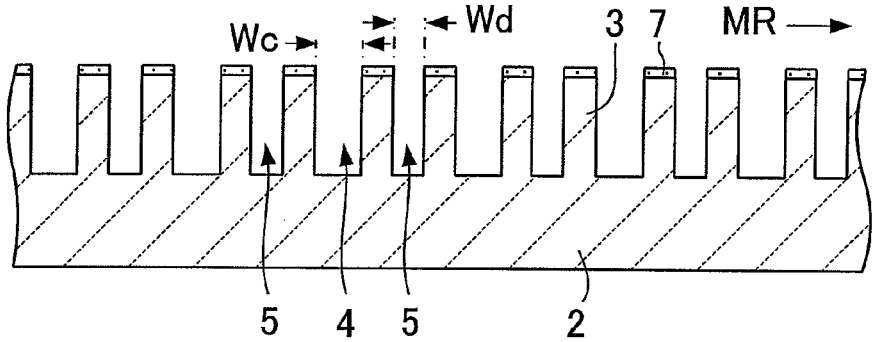
FIGS. 11A to 11C are explanatory diagrams of the method of manufacturing a liquid jet head according to the fifth embodiment of the present invention.
Figure 11B:
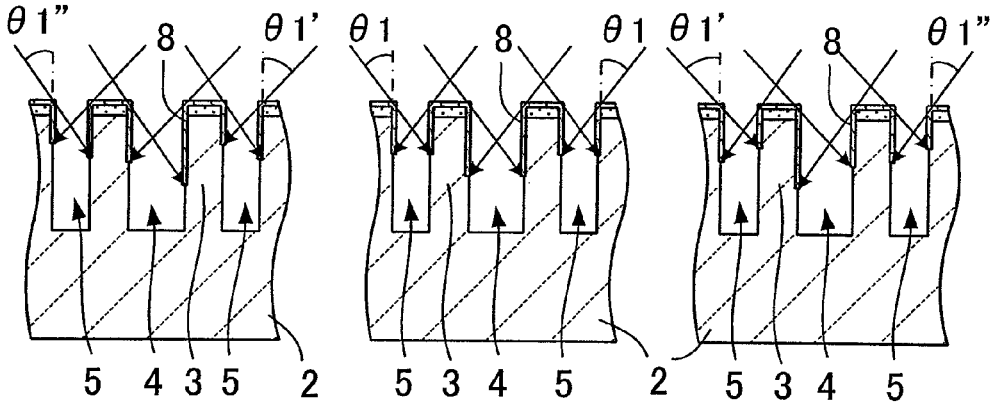
Figure 11C:
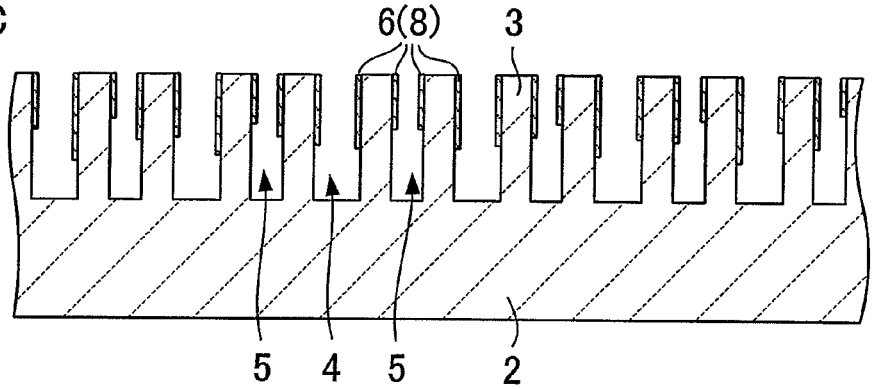

FIGS. 10, and 11A to 11C are explanatory diagrams of a method of manufacturing a liquid jet head 1 according to a fifth embodiment of the present invention. FIG. 10 is a flowchart of a method of manufacturing the liquid jet head 1. FIGS. 11A to 11C are explanatory diagrams of the method of manufacturing the liquid jet head 1, and are cross-sectional schematic diagrams of an actuator substrate 2 in a groove array MR direction. The same portion or a portion having the same function is denoted with the same reference symbol.

A basic method of manufacturing the liquid jet head 1 according to the fifth embodiment includes a groove formation step S21 of forming a groove array MR in which ejection grooves 4 and non-ejection grooves 5 having a different groove width from the ejection grooves 4 are alternately arrayed, on a surface (upper surface UP) of the actuator substrate 2, and an electrode material deposition step S3 of depositing an electrode material on the upper surface UP of the actuator substrate 2, and side surfaces of the ejection grooves 4 and the non-ejection grooves 5 by an oblique vapor deposition method. Accordingly, an average depth of two drive electrodes 6 positioned on facing side surfaces of the ejection groove 4 (non-ejection groove 5) becomes deeper than an average depth of two drive electrodes 6 positioned on facing side surfaces of the non-ejection groove 5 (ejection groove 4) adjacent to the ejection groove 4 (non-ejection groove 5). This relationship is satisfied among the ejection groove 4 and the non-ejection grooves 5 adjacent to both sides of the ejection groove 4. Further, this relationship is satisfied among all of the ejection grooves 4 and the non-ejection grooves 5 of the groove array MR. As a result, as described in the first embodiment, dependence of an electrode depth of an effective drive electrode 6 of a partition 3 on a substrate position is decreased, and variation in an average displacement amount Δdm or an average deformation amount Δsm of two partitions 3 is decreased, and an ejection condition of liquid droplets of an ejection channel C is equalized.

Hereinafter, description will be given specifically using FIGS. 10, and 11A to 11C. First, in a resin film pattern formation step S1, a pattern of a resin film 7 is formed on the upper surface UP (surface) of the actuator substrate 2. The actuator substrate 2, the resin film 7, and the pattern shape of the resin film 7 are similar to the resin film pattern formation step S1 of the fourth embodiment, and thus description is omitted.

Next, as illustrated in FIG. 11A, in the groove formation step S21, the ejection grooves 4 having a groove width Wc and the non-ejection grooves 5 having a groove width Wd narrower than the groove width Wc are alternately formed in the groove array MR direction across the partitions 3 on the upper surface UP of the actuator substrate 2. To be specific, the ejection grooves 4 can be collectively ground and formed using a dicing blade having a wide width, and then the non-ejection grooves 5 can be collectively ground using a dicing blade having a narrow width. Alternatively, grooves are formed once using the dicing blade for the non-ejection grooves 5 having a narrow width, and then the dicing blade is suspended from the upper surface UP and is slightly moved in the groove array MR direction, and the grooves are ground in an overlapping manner, so that the ejection grooves 4 having a larger width than the dicing blade can be formed. As the actuator substrate 2, for example, a PZT ceramic or a $BaTiO_3$ ceramic can be used. The ejection grooves 4 and the non-ejection grooves 5 can have the groove width of 20 to 100 μm, and the groove depth of 100 to 400 μm.

Next, as illustrated in FIG. 11B, in the electrode material deposition step S3, the electrode material is deposited on the upper surface UP of the actuator substrate 2 and the side surfaces of the ejection grooves 4 and the non-ejection grooves 5 by the oblique vapor deposition method. In this case, the electrode 8 is deposited deeper on the side surfaces of the ejection grooves 4 having the larger groove width We than on the side surfaces of the non-ejection grooves 5 having the narrower groove width Wd. Next, as illustrated in FIG. 11C, in a resin film removal step S4, the resin film 7 is removed, and the conductive material deposited on an upper surface of the resin film 7 (lift-off method). As a result, the electrodes 8 deposited on the both side surfaces of the ejection grooves 4 and the non-ejection grooves 5 remain as the drive electrodes 6, and the electrodes 8 on the upper surface UP of the actuator substrate 2 remain as common terminals 15*a* and individual terminals 15*b* (not illustrated). Therefore, similarly to the description in the first embodiment, an average depth (Tmc) of depths Tc1 and Tc2 of two drive electrodes 6 positioned on facing side surfaces of the ejection groove 4 becomes deeper than an average depth (Tmd) of depths Td1 and Td2 of two drive electrodes 6 positioned on facing side surfaces of the non-ejection groove 5 adjacent to the ejection groove 4. That is, a relationship of Tmc>Tmd is satisfied. This relationship between the average depth Tmc of the two drive electrodes 6 of the ejection groove 4, and the average depth Tmd of the two drive electrodes 6 of the non-ejection groove 5 adjacent to the ejection groove 4 is satisfied among the ejection groove 4 and the non-ejection grooves 5 adjacent to both sides of the ejection groove 4. Further, the above-described relationship is satisfied among all of adjacent ejection grooves 4 and non-ejection grooves 5 of the groove array MR. A cover plate bonding step S5 and a nozzle plate adhesion step S6 are similar to those in the fourth embodiment, and thus description is omitted.

Sixth Embodiment

Figure 12:
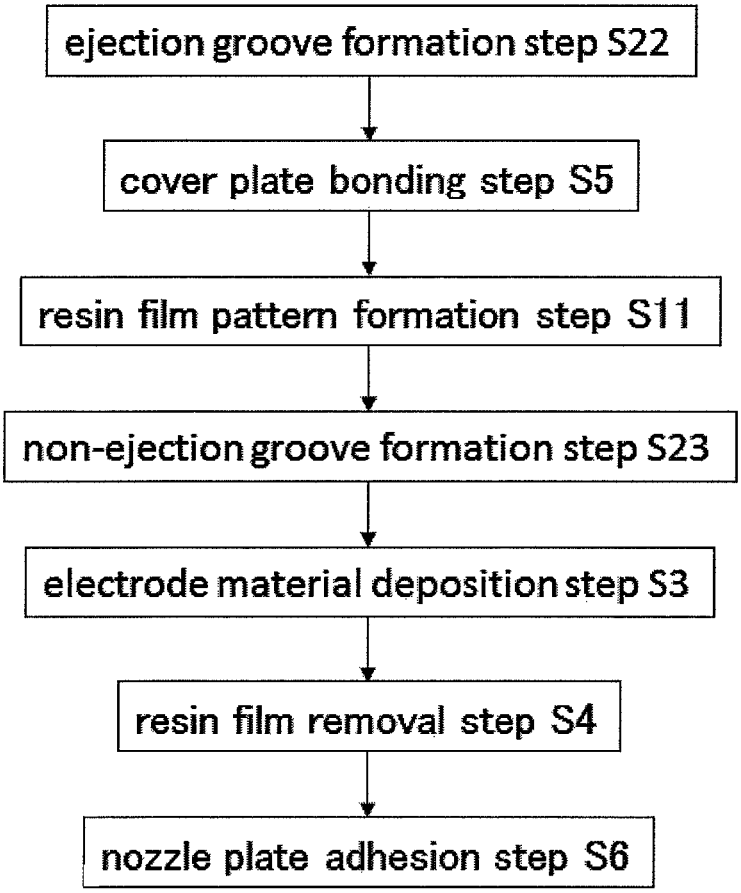
FIG. 12 is a flowchart of a method of manufacturing a liquid jet head according to a sixth embodiment of the present invention.

FIGS. 12 to 15D are explanatory diagrams of a method of manufacturing a liquid jet head 1 according to a sixth embodiment of the present invention. FIG. 12 is a flowchart of the method of manufacturing the liquid jet head 1 according to the sixth embodiment of the present invention, FIGS. 13A to 15D are explanatory diagrams of the method of manufacturing the liquid jet head 1 according to the sixth embodiment of the present invention. The same portion or a portion having the same function is denoted with the same reference symbol.

A basic method of manufacturing the liquid jet head 1 according to the sixth embodiment includes a resin film pattern formation step S1, a groove formation step S2, and an electrode material deposition step S3. The resin film pattern formation step S1 forms a pattern of a resin film 7 on a surface (upper surface UP) of an actuator substrate 2. In this case, the resin film 7 remain on either side of a non-ejection groove 5 or an ejection groove 4, of a partition region Rw between the ejection groove 4 and the non-ejection groove 5, and the resin film 7 is removed from the other side. The groove formation step S2 forms a groove array MR in which the ejection grooves 4 and the non-ejection grooves 5 are alternately arrayed on the surface of the actuator substrate 2. The electrode material deposition step S3 deposits an electrode material on the surface of the actuator substrate 2 and side surfaces of the ejection grooves 4 and the non-ejection grooves 5 by an oblique vapor deposition method. Note that a step of forming the ejection grooves 4 and the non-ejection grooves 5 may be separated from the groove formation step S2. That is, after the ejection grooves 4 or the non-ejection grooves 5 are formed, another step is performed, and then the non-ejection grooves 5 or the ejection grooves 4 may be formed. Further, the groove formation step S2 may be performed prior to the resin film pattern formation step S1.

For example, in the resin film pattern formation step S1, the resin film 7 remain on the side of the non-ejection grooves 5 of the partition region Rw, and the resin film 7 is removed from the side of the ejection grooves 4 of the partition region Rw. As a result, in oblique vapor deposition of the electrode material in the electrode material deposition step S3, the electrode material deposited on the both side surfaces of the ejection grooves 4 is deposited deeper than the electrode material deposited on the both side surfaces of the non-ejection grooves 5 by the thickness of the resin film 7. If the resin film 7 remains on the side of the ejection grooves 4 of the partition region Rw, and the resin film 7 is removed from the side of the non-ejection grooves 5, the electrode material deposited on the both side surfaces of the non-ejection grooves 5 is deposited deeper than the electrode material deposited on the both side surfaces of the ejection grooves 4 by the thickness of the resin film 7. That is, an average depth of two drive electrodes 6 positioned on facing side surfaces of the ejection groove 4 (or the non-ejection groove 5) is deeper than an average depth of two drive electrodes 6 positioned on facing side surfaces of the non-ejection groove 5 (or the ejection groove 4) adjacent to the ejection groove 4 (or the non-ejection groove 5). This relationship is satisfied among the ejection groove 4 and the non-ejection grooves 5 adjacent to both sides of the ejection groove 4. Further, the above-described relationship is satisfied among all of ejection grooves 4 and non-ejection grooves 5 of the groove array MR. As a result, as described in the first embodiment, dependence of an electrode depth of an effective drive electrode 6 of a partition 3 on a substrate position is decreased, and an average displacement amount Δdm or an average deformation amount Δsm of two partitions 3 is decreased, and an ejection condition of droplets of an ejection channel C is equalized.

Figure 13A:
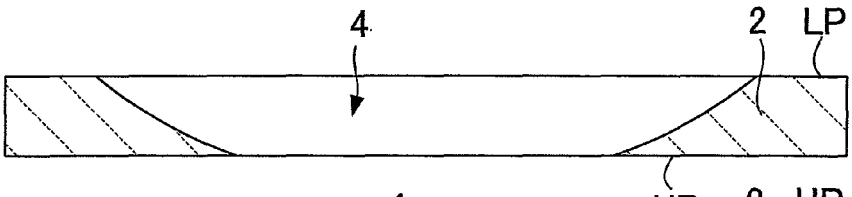
FIGS. 13A to 13D are explanatory diagrams of the method of manufacturing a liquid jet head according to the sixth embodiment of the present invention.
Figure 13B:
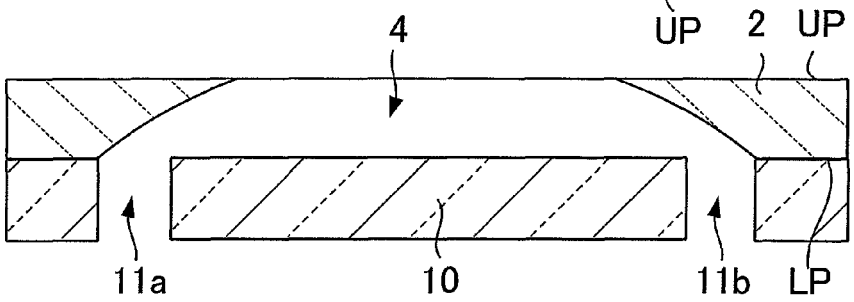
Figure 13C:
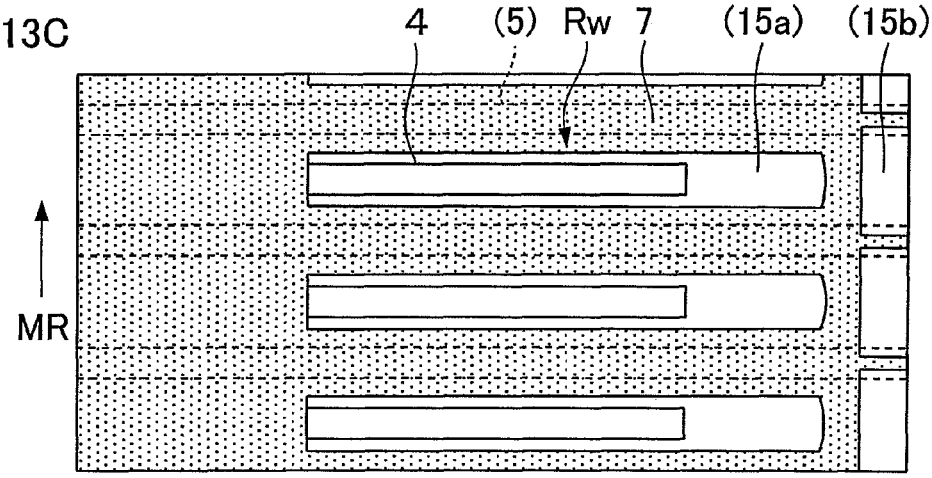
Figure 13D:
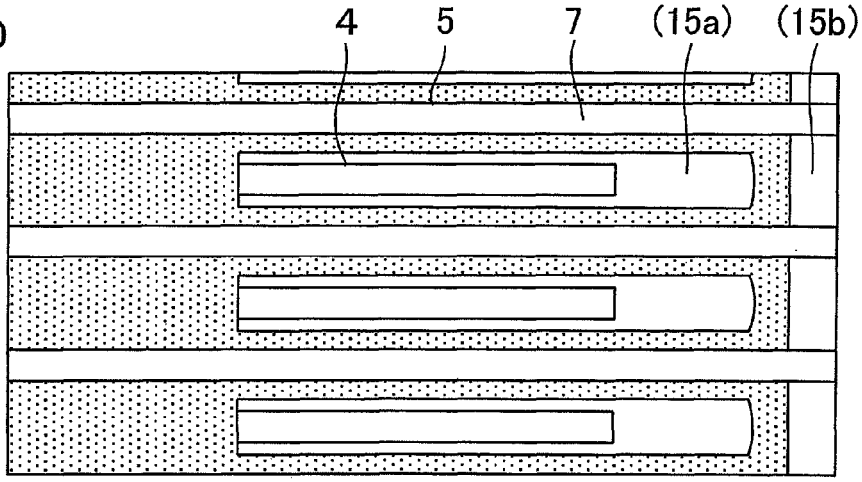
Figure 14A:
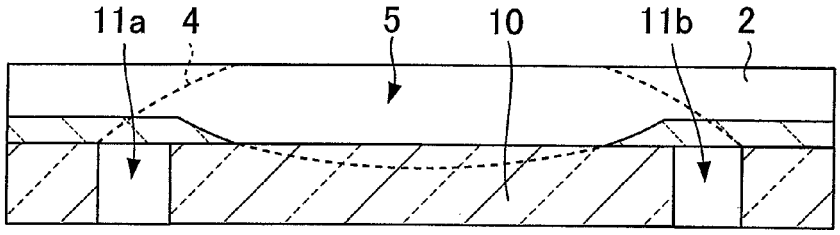
FIGS. 14A to 14E are explanatory diagrams of the method of manufacturing a liquid jet head according to the sixth embodiment of the present invention.
Figure 14B:
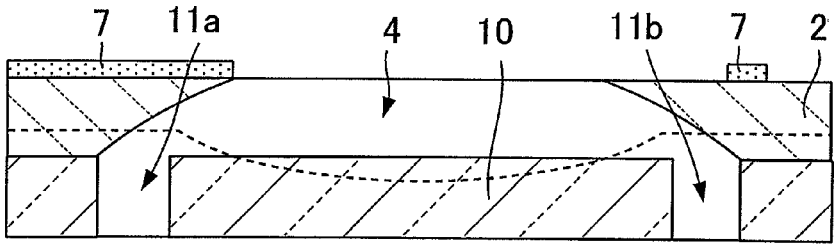
Figure 14C:
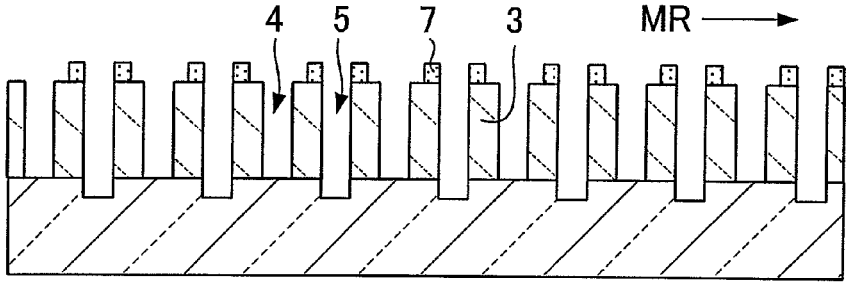
Figure 14D:
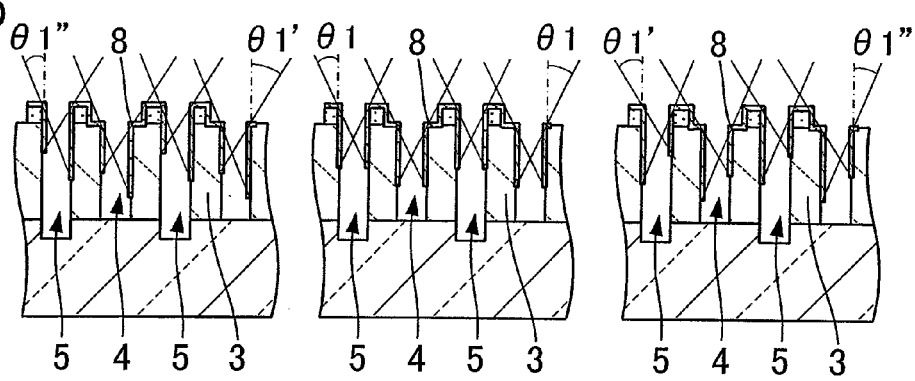
Figure 14E:
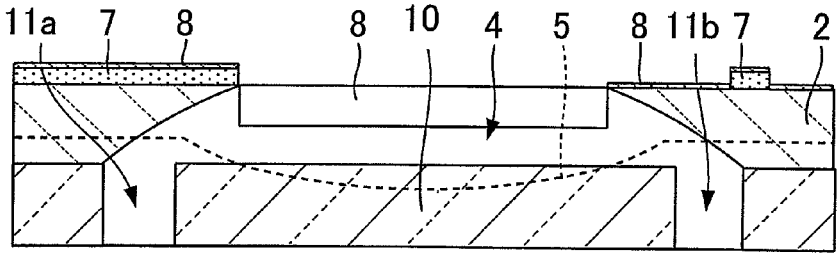
Figure 15A:
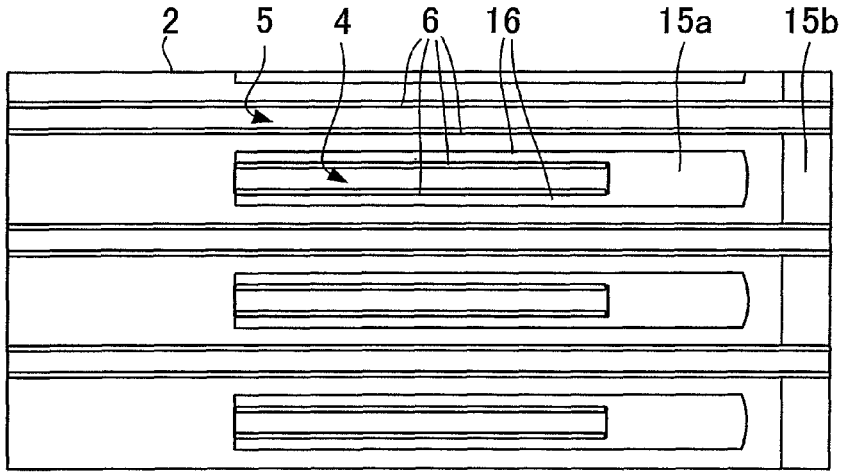
FIGS. 15A to 15D are explanatory diagrams of the method of manufacturing a liquid jet head according to the sixth embodiment of the present invention.
Figure 15B:
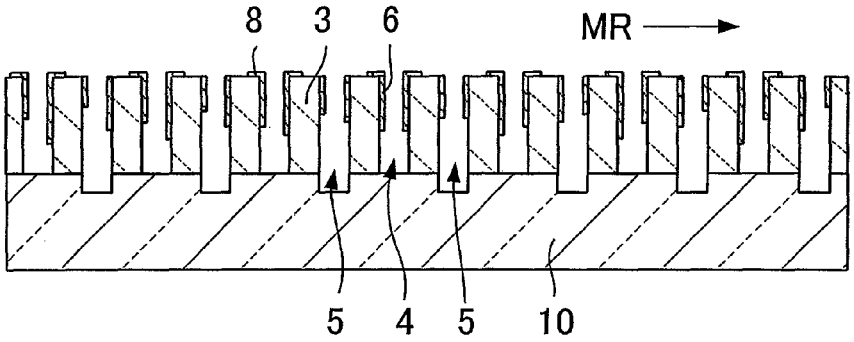
Figure 15C:
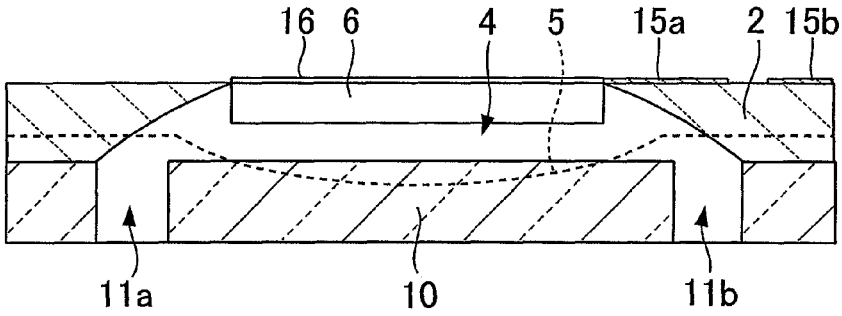
Figure 15D:
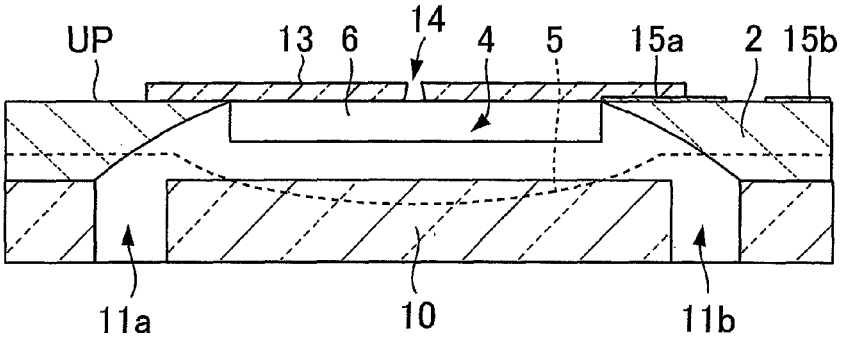

Hereinafter, specific description will be given using FIGS. 12 to 15D. FIGS. 13A and 13B are cross-sectional schematic diagrams of the ejection groove 4 of the actuator substrate 2 in the groove direction. FIGS. 13C and 13D are schematic diagrams of the upper surface UP of the actuator substrate 2. FIGS. 14A and 14B are cross-sectional schematic diagrams of the non-ejection groove 5 and the ejection groove 4 of the actuator substrate 2 in the groove direction. FIGS. 14C and 14D are cross-sectional schematic diagrams of the actuator substrate 2 in the groove array MR direction. FIG. 14E is a cross-sectional schematic diagram of the ejection groove 4 of the actuator substrate 2 in the groove direction. FIG. 15A is a schematic diagram of the upper surface UP of the actuator substrate 2. FIG. 15B is a cross-sectional schematic diagram of the actuator substrate 2 in the groove array MR direction. FIGS. 15C and 15D are cross-sectional schematic diagrams of the ejection groove 4 of the actuator substrate 2 in the groove direction.

As illustrated in FIGS. 12 and 13A, in an ejection groove formation step S22, the ejection grooves 4 are formed on a surface (lower surface LP) of the actuator substrate 2. A plurality of ejection grooves 4 are arrayed in the groove array MR direction in the depth of the sheet surface. As the actuator substrate 2, a piezoelectric material such as a PZT ceramic or a $BaTiO_3$ ceramic is used, and polarization processing is applied on the surface in a normal line direction or in its opposite direction. The ejection grooves 4 can be formed using a dicing blade or the like. The ejection grooves 4 may not be caused to penetrate from the lower surface LP (back surface) to the upper surface UP (surface), and may be caused to penetrate by grinding the upper surface UP later.

Next, as illustrated in FIGS. 12 and 13B, in a cover plate bonding step S5, a cover plate 10 is bonded to the lower surface LP of the actuator substrate 2. The cover plate 10 includes two parallel liquid chambers 11*a* and 11*b* that are long and narrow in the groove array MR direction in the depth of the sheet surface, and are separated from each other. One liquid chamber 11*a* communicates into one end portions of the plurality of ejection grooves 4, and the other liquid chamber 11*b* communicates into the other end portions of the plurality of ejection grooves 4.

Next, as illustrated in FIGS. 12 and 13C, in a resin film pattern formation step S11, a photosensitive resin film made of a resist or the like is installed on the upper surface UP of the actuator substrate 2, and then the pattern of the resin film 7 is formed by a photolithography step. Next, as for the pattern of the resin film 7, the resin film 7 at the side of the non-ejection groove 5, of the partition region Rw that forms the partition 3 between the ejection groove 4 and the non-ejection groove 5, remains, and the resin film 7 at the side of the ejection groove 4 is removed. At the same time, the resin film 7 is removed from regions where the common terminal 15*a* and the individual terminal 15*b* are formed. The region where the common terminal 15*a* is formed is positioned at the side of the ejection groove 4 between an end portion of the ejection groove 4 in the groove direction and the other end of the actuator substrate 2, and the region where the individual terminal 15*b* is formed is positioned at the other end side between the end portion of the ejection groove 4 in the groove direction and the other end of the actuator substrate 2. The film thickness of the resin film 7 is a difference between the electrode depth of the ejection groove 4 and the electrode depth of the non-ejection groove adjacent to the ejection groove 4. For example, when the difference of the average depth of the two drive electrodes 6 positioned on the facing side surfaces of the non-ejection groove 5 adjacent to the ejection groove 4 with respect to the average depth of the two drive electrodes 6 positioned on the facing side surfaces of the ejection groove 4 is 20 μm, the film thickness of the resin film 7 is 20 μm. Note that, in the present embodiment, the resin film 7 at the side of the non-ejection groove 5, of the partition region Rw, is removed, and the resin film 7 at the side of the ejection groove 4 is removed. However, instead, the resin film 7 at the side of the ejection groove 4 may remain, and the resin film 7 at the side of the non-ejection groove 5 may be removed.

Note that the region where the resin film 7 at one side of the non-ejection groove 5 or the ejection groove 4 remains and the resin film 7 at the other side is removed in the resin film pattern formation step S11 is only regions at both end sides outside a predetermined position of the groove array MR, and in other regions, the resin film 7 at both sides of the non-ejection groove 5 and the ejection groove 4 may remain, or the resin film 7 at both sides may be removed.

Next, as illustrated in FIGS. 12 and 13D, in a non-ejection groove formation step S23, the non-ejection groove 5 is formed in the upper surface UP of the actuator substrate 2 between two ejection grooves 4 by grinding with a dicing blade or the like. The non-ejection groove 5 has, as illustrated in FIG. 14A, an upside-down shape of the ejection groove 4 in a central portion in the groove direction, and has a shallow bottom with a fixed depth from the upper surface UP in both end portions in the groove direction. The non-ejection groove 5 extends from one end to the other end of the upper surface UP of the actuator substrate 2. The non-ejection groove 5 penetrates the actuator substrate 2 in the central portion in the groove direction, and has a depth reaching the cover plate 10. However, the non-ejection groove 5 does not communicate into the two liquid chambers 11*a* and 11*b* of the cover plate 10. Further, as illustrated in FIGS. 14B and 14C, the resin film 7 is removed at the side of the non-ejection groove 5, of upper end surfaces of both partitions 3 that configure the non-ejection groove 5. In contrast, the resin film 7 does not remain at the side of the ejection groove 4, of upper end surfaces of both partitions 3 that configure the ejection groove 4. The resin film 7 does not remain on the regions where the common terminals 15*a* and the individual terminals 15*b* of the upper surface UP of the actuator substrate 2.

Next, as illustrated in FIGS. 12, 14D, and 14E, in an electrode material deposition step S3, the electrode material is deposited on the upper surface UP of the actuator substrate 2 and the side surfaces of the ejection grooves 4 and the non-ejection grooves 5 by the oblique vapor deposition method. To be specific, oblique vapor deposition of a conductive material is performed from an obliquely right upper portion of an angle θ1 with respect to a normal line of the upper end surface of the partition 3, and then the oblique vapor deposition of a conductive material is performed from an obliquely left upper portion of the same angle θ1 with respect to the normal line of the upper end surface of the partition 3. As already described, deposition direction is different between a left position and a right position of the actuator substrate 2, and the relationship of $\theta 1' > \theta 1 > \theta 1''$ is satisfied. The resin film 7 does not exist on the upper surface UP at the side of the ejection groove 4, of two partitions 3 that sandwich the ejection groove 4, and the resin film 7 exists on the upper surface UP at the side of the non-ejection groove 5, of two partitions 3 that sandwich the non-ejection groove 5. Therefore, an electrode 8 on the side surface of the ejection groove 4 is deposited deeper than an electrode 8 on the side surface of the non-ejection groove 5 by the thickness of the resin film 7. That is, an average depth of two electrodes 8 provided on the side surface of the ejection groove 4 is deeper than an average depth of two electrodes 8 provided on the side surface of the non-ejection groove 5 adjacent to the ejection groove 4 by the thickness of the resin film 7, and this relationship is satisfied among all of adjacent ejection grooves 4 and non-ejection grooves 5 of the groove array MR.

Next, as illustrated in FIGS. 12, and 15A to 15C, in a resin film removal step S4, the resin film 7 is removed from the upper surface UP of the actuator substrate 2, the drive electrodes 6 are formed on the side surfaces of the ejection groove 4 and the non-ejection groove 5, and the common terminal 15*a* electrically connected with the drive electrodes 6 positioned on both side surfaces of the non-ejection groove 5, and the individual terminal 15*b* electrically connected with the drive electrodes 6 positioned on the side surfaces at the sides of the ejection groove 4, of the two non-ejection grooves 5 that sandwich the ejection groove 4, are formed on the upper surface UP of the actuator substrate 2. Note that the drive electrodes 6 of the ejection groove 4 and the common terminal 15*a* on the upper surface UP are electrically connected through a wire 16 positioned on the upper surface UP in the vicinity of an opening end of the ejection groove 4.

Next, as illustrated in FIGS. 12 and 15D, in a nozzle plate adhesion step S6, a nozzle plate 13 adheres to the upper surface UP of the actuator substrate 2. The nozzle plate 13 includes a nozzle 14 communicating into the ejection groove 4. The nozzle plate 13 is narrower than the width of the actuator substrate 2 in the groove direction, and adheres to the upper surface UP such that a part of the common terminal 15*a*, and the individual terminal 15*b* are exposed. Accordingly, the liquid jet head 1 according to the third embodiment illustrated in FIGS. 6A and 6B can be manufactured. Note that the characteristics of the liquid jet head 1 have been described in detail in the first and third embodiments, and thus description here is omitted.

In the present embodiment, the drive electrodes 6, the wire 16, the common terminal 15*a*, and the individual terminal 15*b* can be collectively formed by the two times of the oblique vapor deposition methods. Therefore, the manufacturing method is easy. Further, by control of the thickness of the resin film 7, the difference between the electrode depth of the drive electrodes 6 of the ejection groove 4 and the electrode depth of the drive electrodes 6 of the non-ejection groove 5 adjacent to the ejection groove 4 can be highly accurately controlled.

Note that, similarly to the present embodiment, the liquid jet head 1 of the second embodiment illustrated in FIG. 5 can be manufactured. In this case, the liquid jet head 1 can be manufactured by the resin film pattern formation step S1→the groove formation step S2→the electrode material deposition step S3→the resin film removal step S4→the cover plate bonding step S5→the nozzle plate adhesion step S6. That is, in the resin film pattern formation step S1, the resin film 7 remains on one side of the non-ejection groove 5 and the ejection groove 4, of the partition region Rw between the ejection groove 4 and the non-ejection groove 5, and the resin film 7 is removed from the other side. In the groove formation step S2, the groove array MR in which the ejection grooves 4 and the non-ejection grooves 5 are alternately arrayed on the upper surface UP of the actuator substrate 2 is formed. The electrode material deposition step S3 and the resin film removal step S4 are similar to those of the present embodiment. The cover plate bonding step S5 and the nozzle plate adhesion step S6 are similar to those of the fourth embodiment.

<Liquid Jet Apparatus>

Seventh Embodiment

Figure 16:
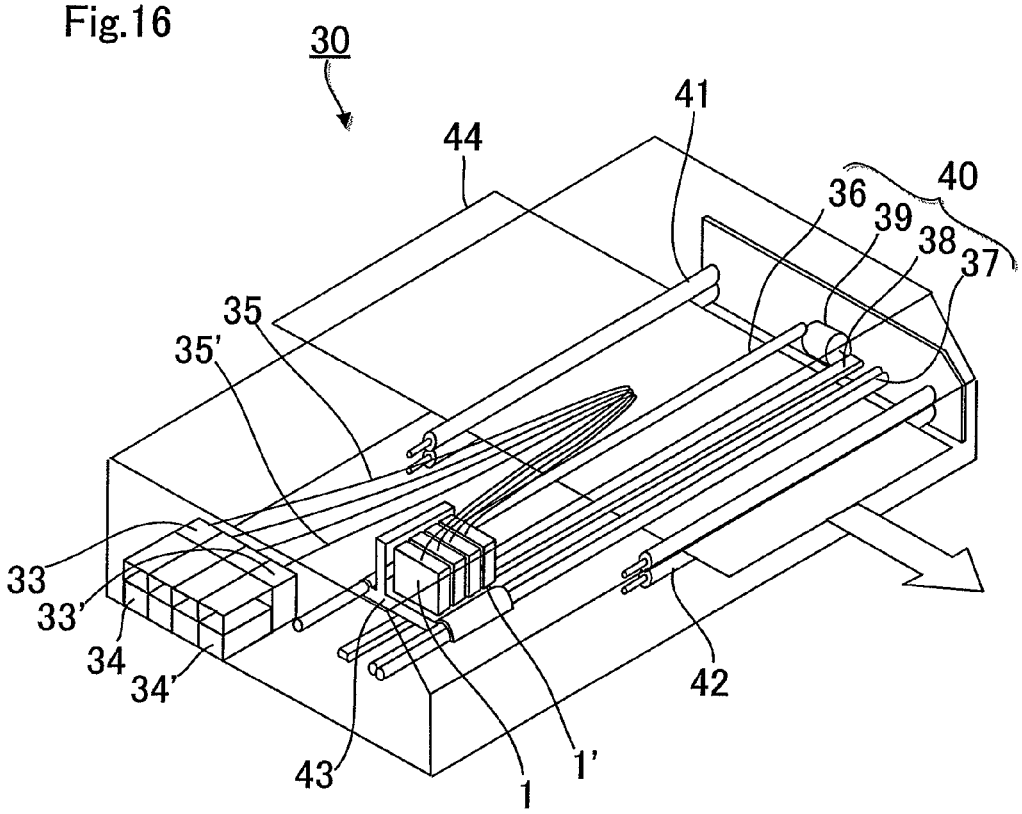
FIG. 16 is a schematic perspective view of a liquid jet apparatus according to a seventh embodiment of the present invention.
Figure 17:
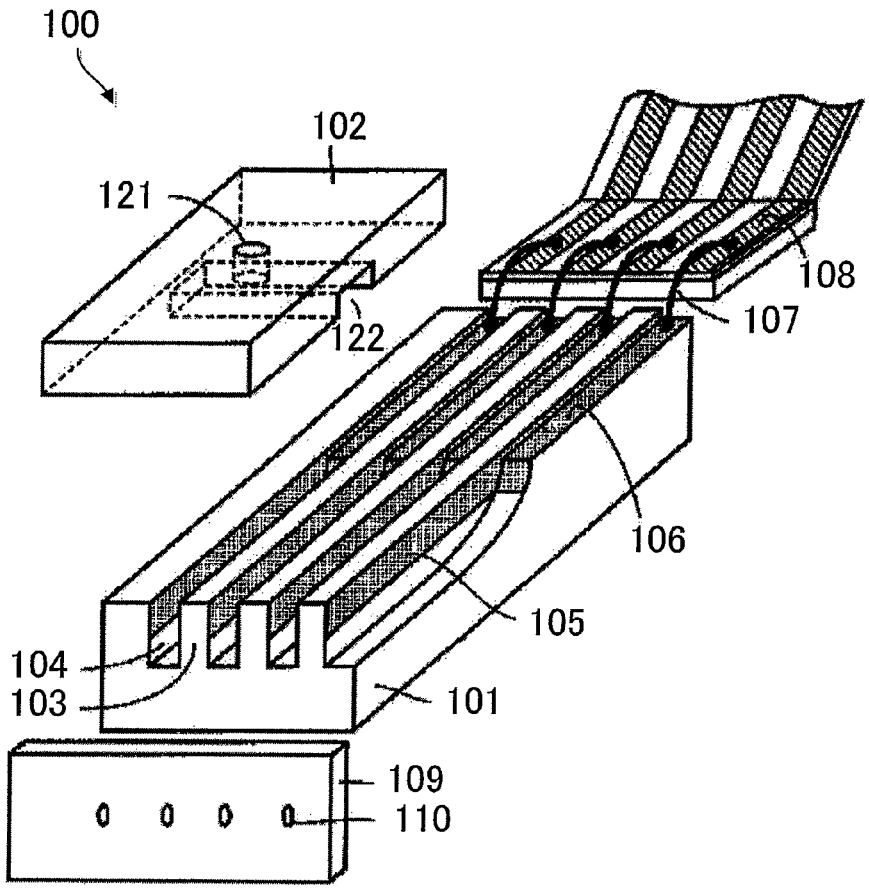
Fig.17 Prior art
FIG. 17 is a perspective view of a conventionally known liquid jet head.
Figure 18A:
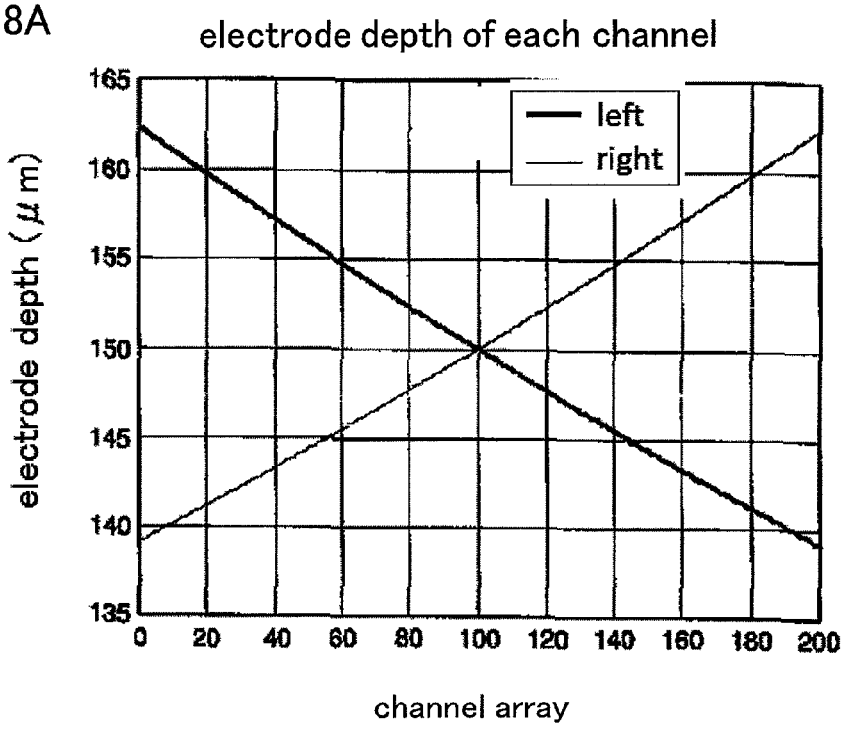
Prior art Fig.18A
FIGS. 18A and 18B are explanatory diagrams of the conventionally known liquid jet head.
Figure 18B:
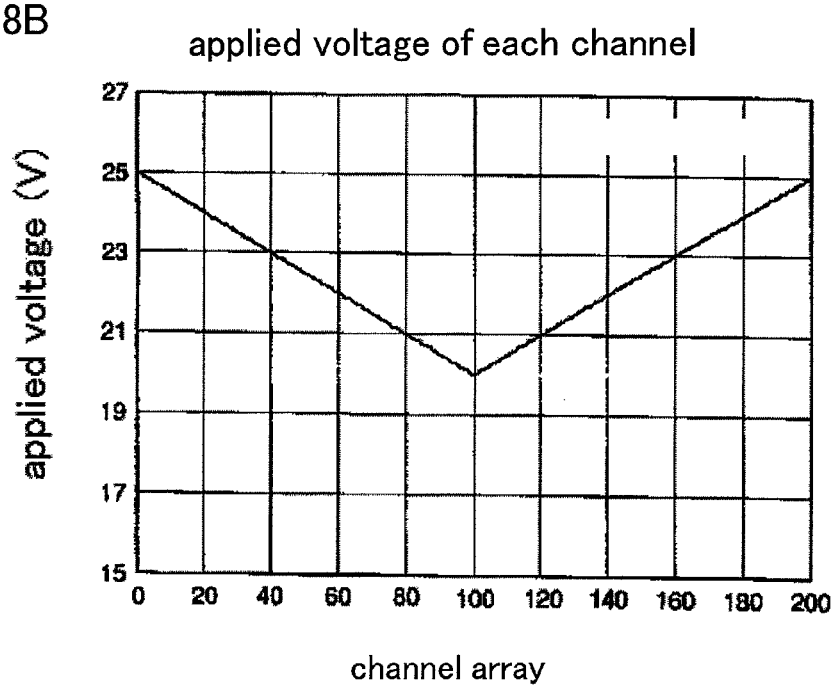
Prior art Fig.18B

FIG. 16 is a schematic perspective view of a liquid jet apparatus 30 according to a seventh embodiment of the present invention. The liquid jet apparatus 30 includes a movement mechanism 40 that reciprocatively moves liquid jet heads 1 and 1', flow path portions 35 and 35' that supply a liquid to the liquid jet heads 1 and 1' and discharge the liquid from the liquid jet heads 1 and 1', liquid pumps 33 and 33' communicating into the flow path portions 35 and 35', and liquid tanks 34 and 34'. As the liquid jet heads 1 and 1', any liquid jet head already described in the first to sixth embodiments is used.

The liquid jet apparatus 30 includes a pair of conveyance units 41 and 42 that convey a recording medium 44 such as a paper in a main scanning direction, the liquid jet heads 1 and 1' that eject the liquid to the recording medium 44, a carriage unit 43 on which the liquid jet heads 1 and 1' are placed, the liquid pumps 33 and 33' that pressurize the liquid stored in the liquid tanks 34 and 34' to the flow path portions 35 and 35' and supply the liquid, and the movement mechanism 40 that scans the liquid jet heads 1 and 1' in a sub-scanning direction perpendicular to the main scanning direction. A control unit (not illustrated) controls and drives the liquid jet heads 1 and 1', the movement mechanism 40, and the conveyance units 41 and 42.

The pair of conveyance units 41 and 42 extends in the sub-scanning direction and includes a grid roller and a pinch roller that are rotated while being in contact with a roller surface. The conveyance units 41 and 42 rotate the grind roller and the pinch roller around axes with a motor (not illustrated) to convey the recording medium 44 sandwiched between the rollers in the main scanning direction. The movement mechanism 40 includes a pair of guide rails 36 and 37 extending in the sub-scanning direction, the carriage unit 43 slidable along the pair of guide rails 36 and 37, an endless belt 38 that connects and moves the carriage unit 43 in the sub-scanning direction, and a motor 39 that rotates the endless belt 38 through a pulley (not illustrated).

The carriage unit 43 places the plurality of liquid jet heads 1 and 1', and ejects four types of droplets: yellow, magenta, cyan, and black. The liquid tanks 34 and 34' store the liquid of corresponding colors, and supply the liquids to the liquid jet heads 1 and 1' through the liquid pumps 33 and 33' and the flow path portions 35 and 35'. The liquid jet heads 1 and 1' eject the liquid droplets of respective colors according to drive signals. An arbitrary pattern can be recorded on the recording medium 44 by control of timing to eject the liquids from the liquid jet heads 1 and 1', rotation of the motor 39 that drives the carriage unit 43, and a conveyance speed of the recording medium 44.

Note that the present embodiment is the liquid jet apparatus 30 in which the movement mechanism 40 moves the carriage unit 43 and the recording medium 44 to perform recording. However, instead, a liquid jet apparatus in which a carriage unit is fixed, and a movement mechanism two-dimensionally moves a recording medium to perform recording may be employed. That is, the movement mechanism may just relatively moves the liquid jet head and the recording medium.

What is claimed is:

1. A liquid jet head comprising:

an alternating array of ejection channels and dummy channels provided in a channel row and separated from one another by partitions; and drive electrodes disposed on opposite side surfaces of the partitions and extending in a depth direction from upper ends of the partitions to a depth that does not reach the bottoms of the ejection channels and the dummy channels, wherein, for at least some of the ejection channels and the dummy channels, an average depth Tmc of the drive electrodes disposed on facing side surfaces of the ejection channel is different from an average depth Tmd of the drive electrodes disposed on facing side surfaces of a dummy channel adjacent to the ejection channel, and wherein the average depth Tmc and the average depth Tmd satisfy a relationship of formula (1):

$$Tmc > Tmd \quad (1).$$

2. The liquid jet head according to claim 1, wherein, for the at least some of the ejection channels and the dummy channels, a groove width of the ejection channels is wider than a groove width of the dummy channels.

3. The liquid jet head according to claim 1, wherein the at least some of the ejection channels and the dummy channels includes dummy channels adjacent to both sides of the ejection channels.

4. The liquid jet head according to claim 3, wherein the at least some of the ejection channels and the dummy channels are positioned at both end sides of the channel row.

5. The liquid jet head according to claim 1; wherein the at least some of the ejection channels and the dummy channels comprises all of the ejection channels and the dummy channels in the channel row.

6. The liquid jet head according to claim 1, wherein a depth of the drive electrode provided on one side surface of the dummy channel gradually becomes deeper as the dummy channel is positioned from one end to the other end of the channel row, and a depth of the drive electrode provided on the other side surface of the dummy channel gradually becomes shallower as the dummy channel is positioned from the one end to the other end of the channel row.

7. The liquid jet head according to claim 1, wherein a depth of the drive electrode provided on one side surface of the ejection channel gradually becomes deeper as the ejection channel is positioned from one end to the other end of the channel row, and a depth of the drive electrode provided on the other side surface of the ejection channel gradually becomes shallower as the ejection channel is positioned from the one end to the other end of the channel row.

8. A liquid jet apparatus comprising:

the liquid jet head according to claim 1;

a movement mechanism configured to relatively move the liquid jet head and a recording medium;

a liquid supply tube configured to supply a liquid to the liquid jet head; and a liquid tank configured to supply the liquid to the liquid supply tube.

9. A liquid jet head comprising:

an alternating array of ejection channels and dummy channels provided in a channel row and separated from one another by partitions; and drive electrodes disposed on opposite side surfaces of the partitions and extending in a depth direction from upper ends of the partitions to a depth that does not reach the bottoms of the election channels and the dummy channels, wherein, for at least some of the ejection channels and the dummy channels, an average depth Tmc of the drive electrodes disposed on facing side surfaces of the ejection channel is different from an average depth Tmd of the drive electrodes disposed on facing side surfaces of a dummy channel adjacent to the ejection channel, and wherein the average depth Tmc and the average depth Tmd satisfy a relationship of formula (2):

$$Tmc<Tmd \quad (2).$$

10. The liquid jet head according to claim 9, wherein, for the at least some of the ejection channels and the dummy channels, a groove width of the ejection channels is narrower than a groove width of the dummy channels.

11. The liquid jet head according to claim 9, wherein the at least some of the ejection channels and the dummy channels includes dummy channels adjacent to both sides of the ejection channels.

12. The liquid jet head according to claim 11, wherein the at least some of the ejection channels and the dummy channels are positioned at both end sides of the channel row.

13. The liquid jet head according to claim 9; wherein the at least some of the ejection channels and the dummy channels comprises all of the ejection channels and the dummy channels in the channel row.

* * * * *